US011005164B2

(12) United States Patent
Kim

(10) Patent No.: US 11,005,164 B2
(45) Date of Patent: May 11, 2021

(54) RING-SHAPED ANTENNA AND EARPHONE MODULE HAVING SAME

(71) Applicant: AMOTECH CO., LTD., Incheon (KR)

(72) Inventor: Beon-Jin Kim, Bucheon-si (KR)

(73) Assignee: AMOTECH CO., LTD., Incheon (KR)

( * ) Notice: Subject to any disclaimer, the term of this patent is extended or adjusted under 35 U.S.C. 154(b) by 0 days.

(21) Appl. No.: 16/499,186

(22) PCT Filed: Jun. 9, 2017

(86) PCT No.: PCT/KR2017/006030
§ 371 (c)(1),
(2) Date: Sep. 27, 2019

(87) PCT Pub. No.: WO2018/182091
PCT Pub. Date: Oct. 4, 2018

(65) Prior Publication Data

US 2020/0028246 A1 Jan. 23, 2020

(30) Foreign Application Priority Data

Mar. 31, 2017 (KR) ..... 10-2017-0041612
Mar. 31, 2017 (KR) ..... 10-2017-0041613

(51) Int. Cl.
*H01Q 1/27* (2006.01)
*H01Q 1/36* (2006.01)
*H04R 1/10* (2006.01)

(52) U.S. Cl.
CPC ..... *H01Q 1/273* (2013.01); *H01Q 1/36* (2013.01); *H04R 1/1016* (2013.01);
(Continued)

(58) Field of Classification Search
CPC ..... H01Q 1/46; H01Q 5/10; H01Q 1/273; H01Q 1/36; H04R 1/1025; H04R 1/1041; H04R 1/1058; H04R 1/1016
See application file for complete search history.

(56) References Cited

U.S. PATENT DOCUMENTS 9,124,992 B2 9/2015 Jang
2014/0016806 A1* 1/2014 Polinske ..... H01Q 1/2208 381/315

(Continued)

FOREIGN PATENT DOCUMENTS

KR 10-2007-0109766 A 11/2007
KR 10-1236443 B1 2/2013

(Continued)

*Primary Examiner* — Kile O Blair
(74) *Attorney, Agent, or Firm* — Maschoff Brennan

(57) ABSTRACT

Disclosed are: a ring-shaped antenna, which is formed in a ring shape and mounted between an earphone module housing and the outer circumference of a coin-type battery so as to communicate, through an NFMI, with an antenna mounted in another earphone module; and a wireless earphone module having the same. The disclosed ring-shaped antenna comprises: a flexible base sheet; a terminal sheet formed to extend from one side of the base sheet; a first terminal formed on one surface of the terminal sheet; a second terminal, formed on one surface of the terminal sheet, to be spaced apart from the first terminal; and a radiation pattern formed on one surface of the base sheet, and having one end connected to the first terminal and having the other end connected to the second terminal.

13 Claims, 20 Drawing Sheets

(52) U.S. Cl.
CPC ..... *H04R 1/1025* (2013.01); *H04R 1/1041* (2013.01); *H04R 1/1058* (2013.01); *H04R 2420/07* (2013.01)

(56) References Cited

U.S. PATENT DOCUMENTS

2014/0307904 A1* 10/2014 Polinske ..... H04R 25/554 381/323
2016/0205461 A1 7/2016 Fernandez-Medina et al.

FOREIGN PATENT DOCUMENTS

KR 10-2015-0089376 A 8/2015
KR 10-2016-0105907 A 9/2016

* cited by examiner

[FIG. 1]
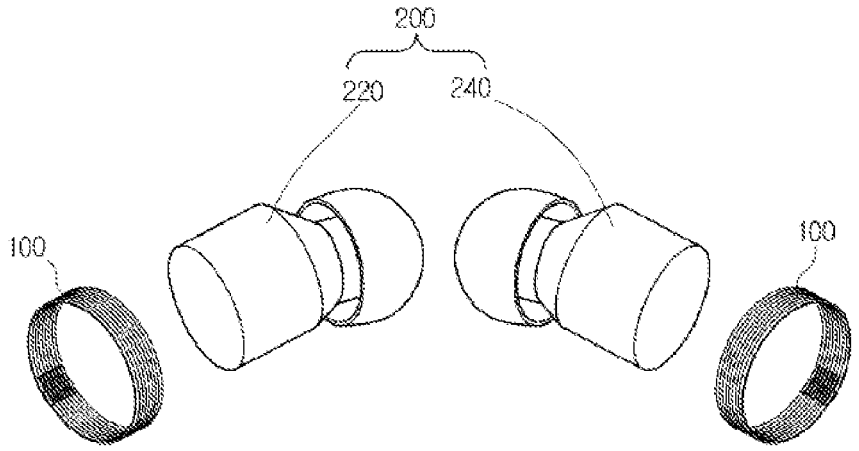
[FIG. 2]
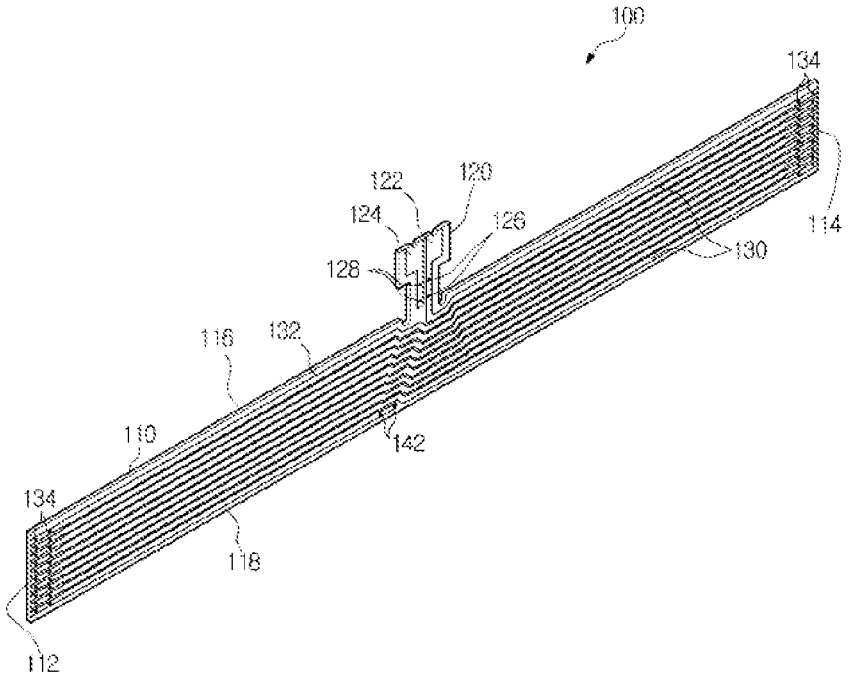

[FIG. 3]
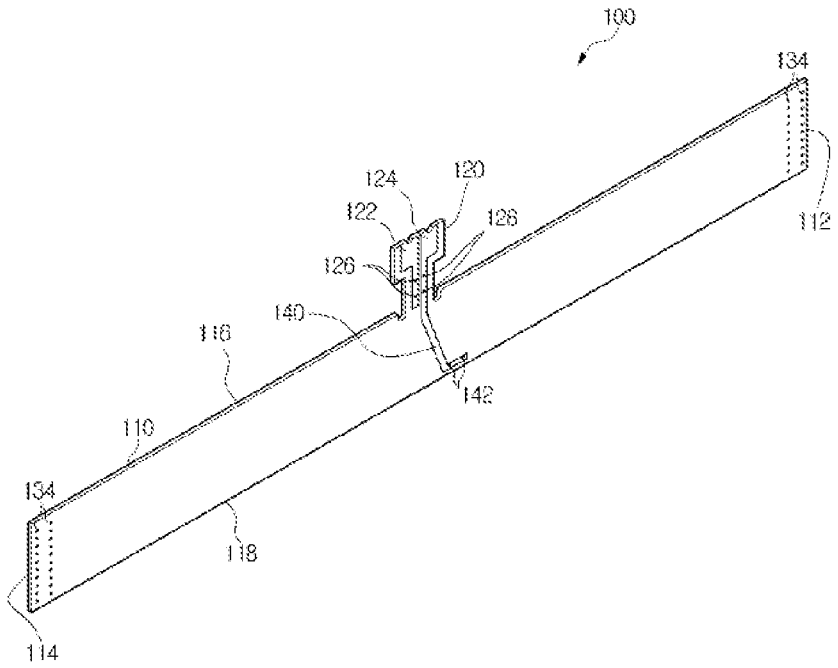
[FIG. 4]
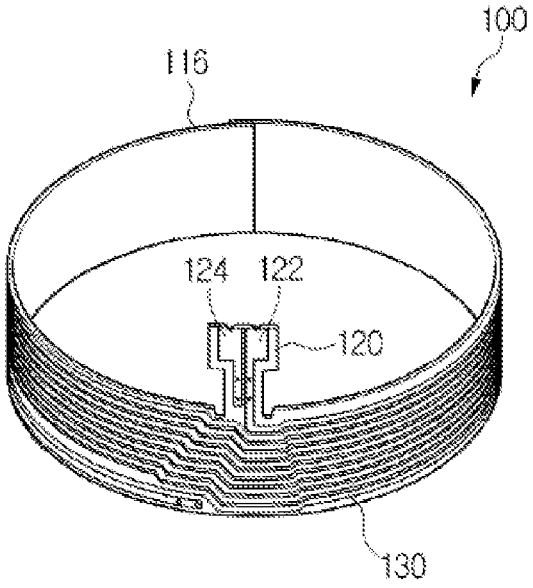

[FIG. 5]
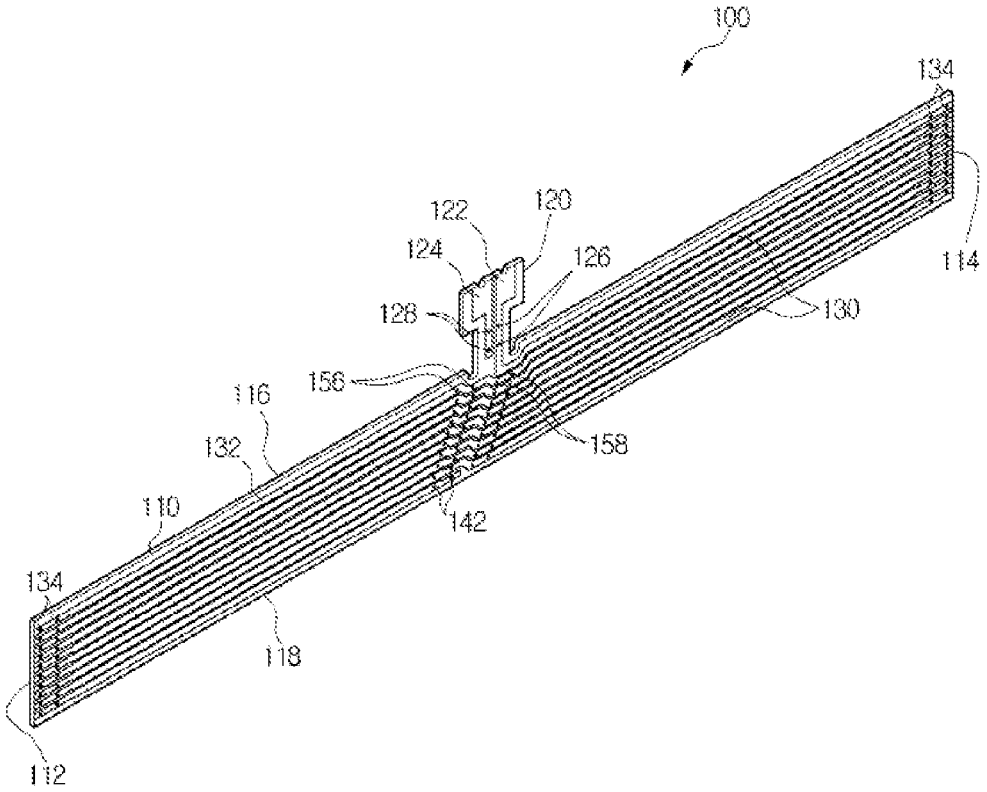

[FIG. 6]
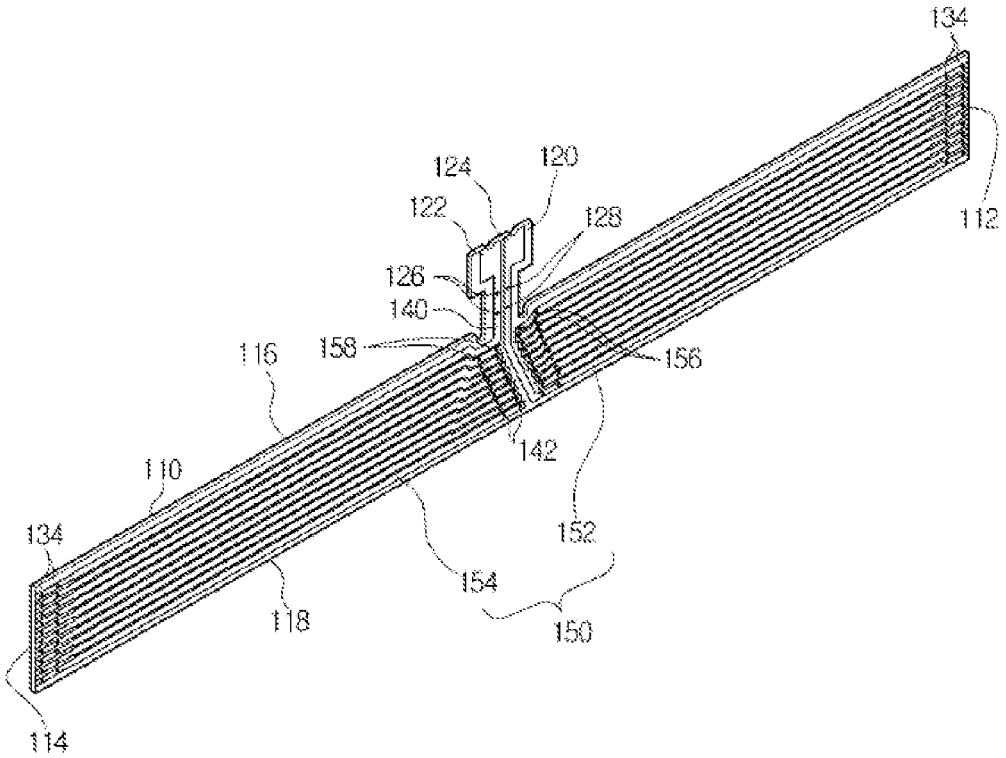

[FIG. 7]
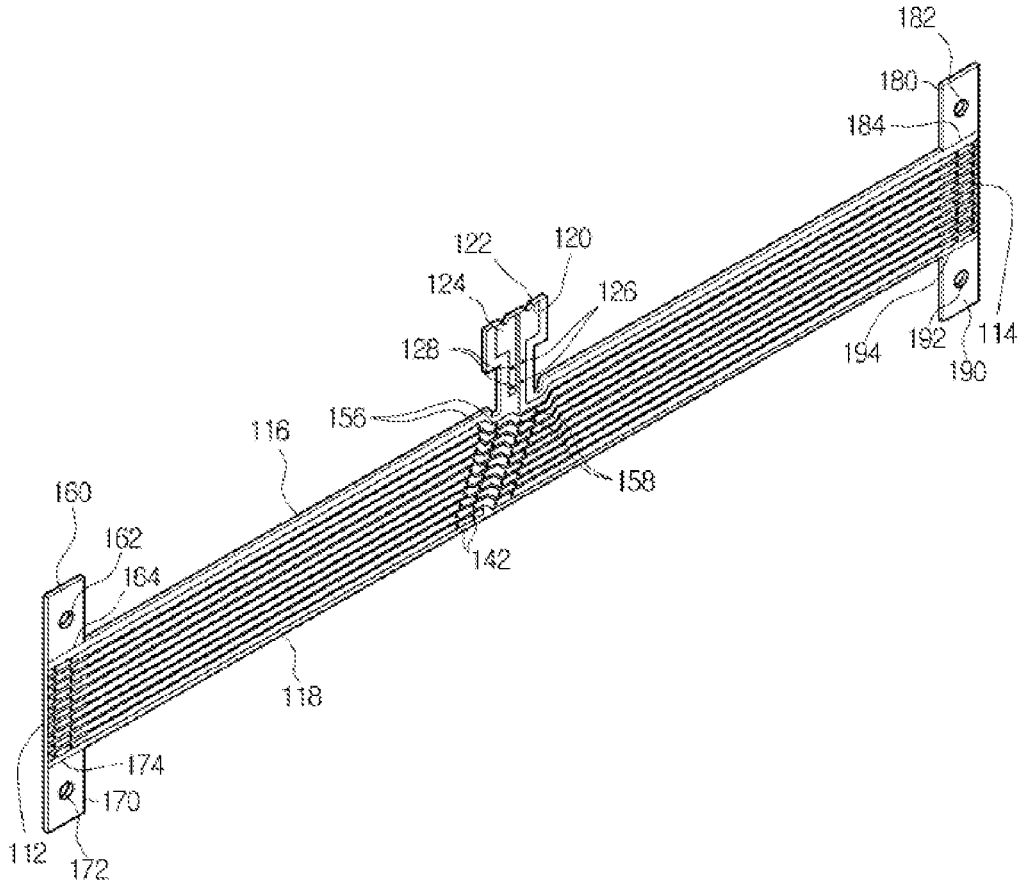

[FIG. 8]
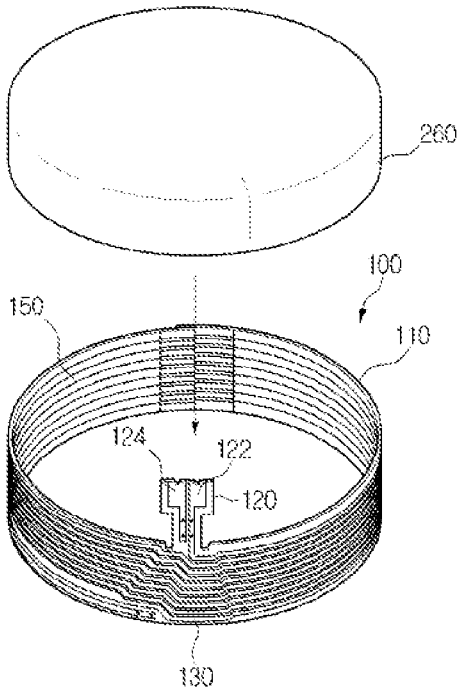
[FIG. 9]
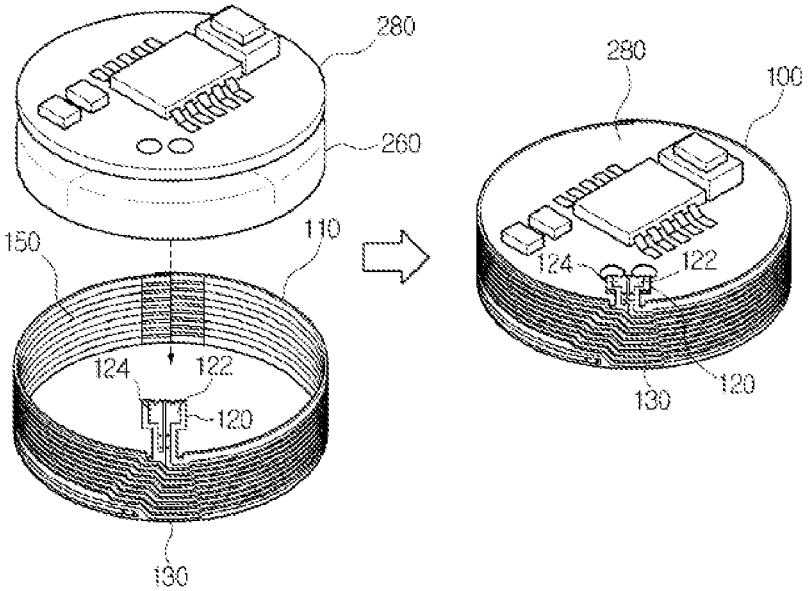

[FIG. 10]
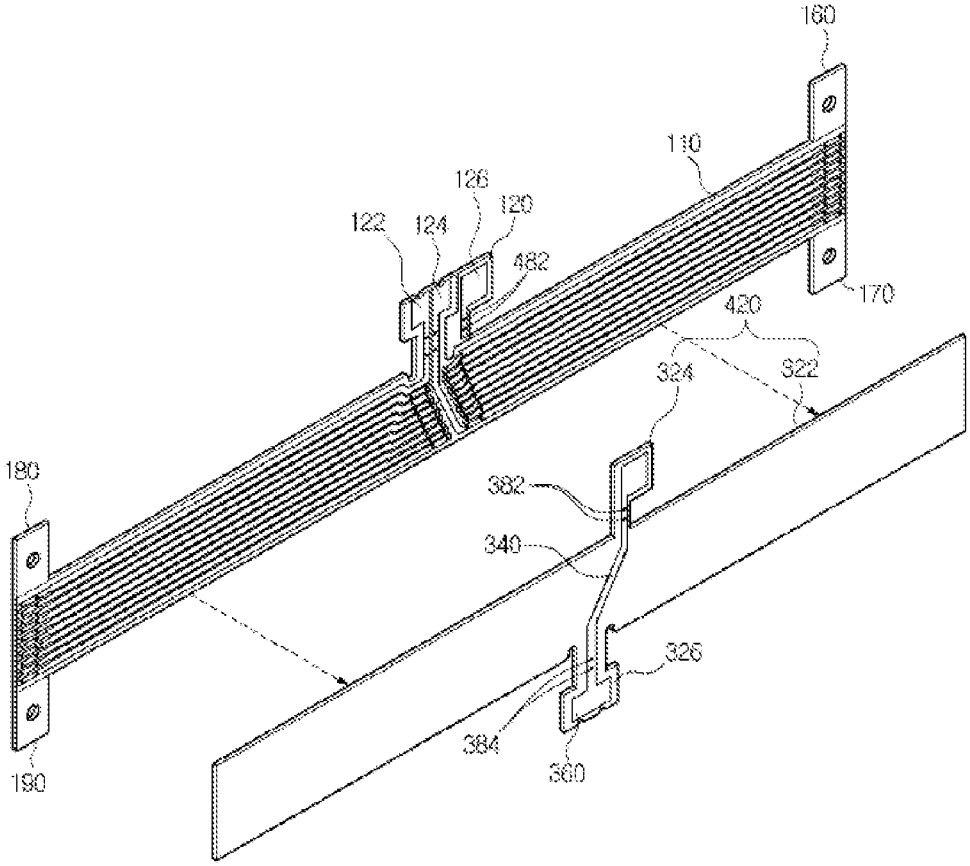

[FIG. 11]
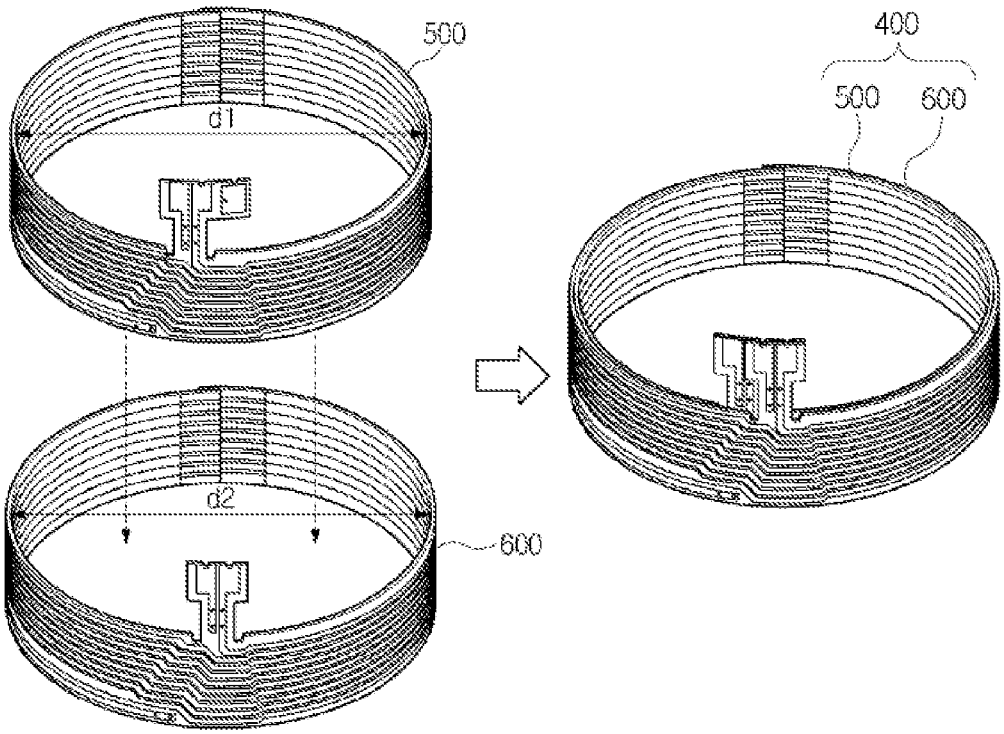

[FIG. 12]
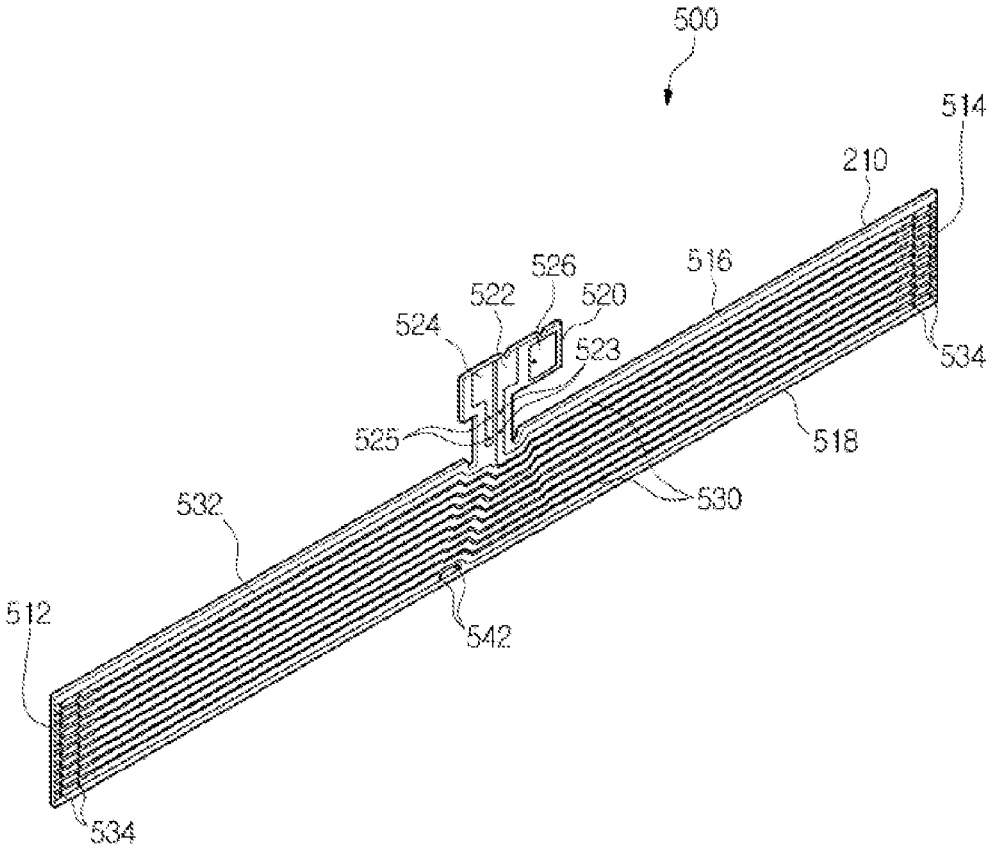

[FIG. 13]
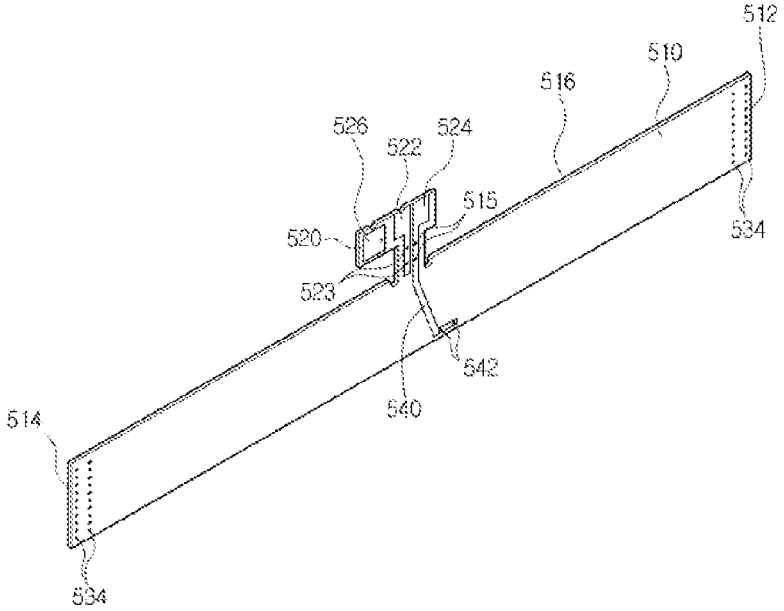
[FIG. 14]
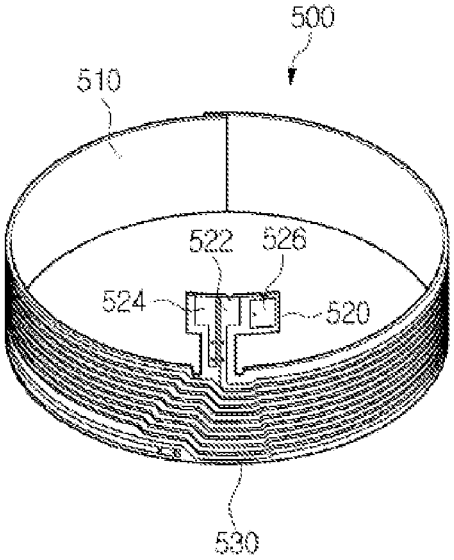

[FIG. 15]
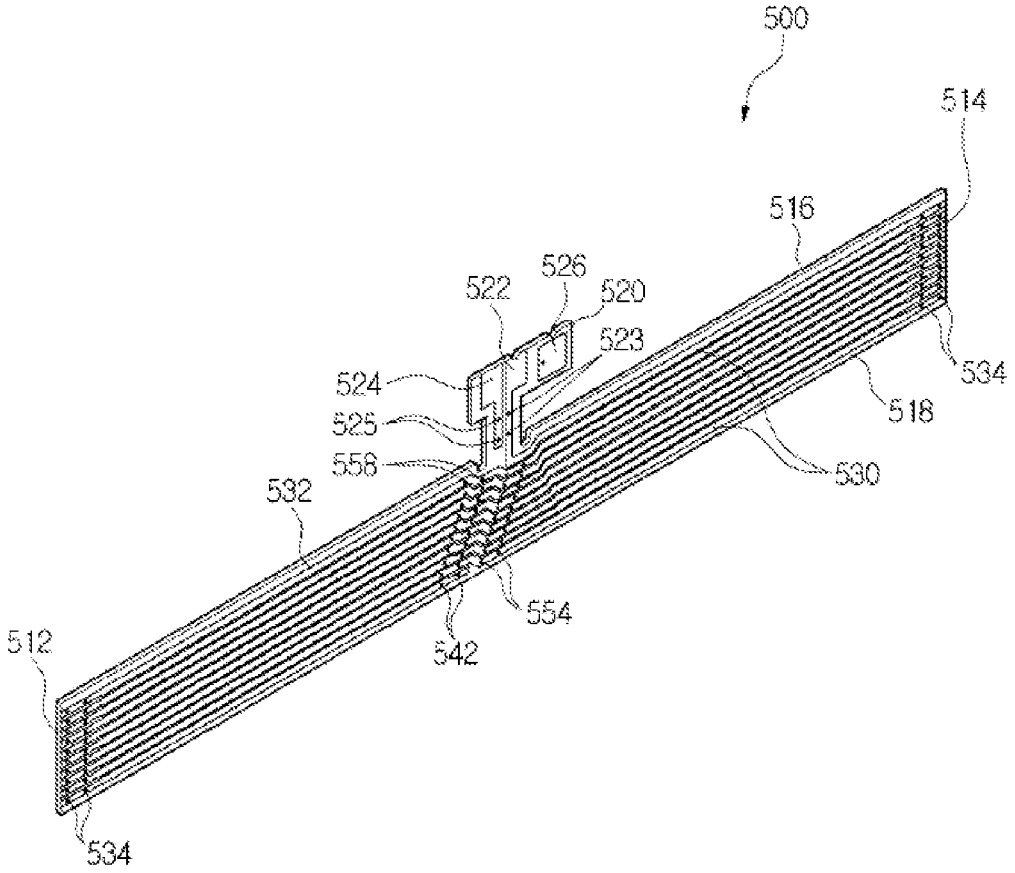

[FIG. 16]
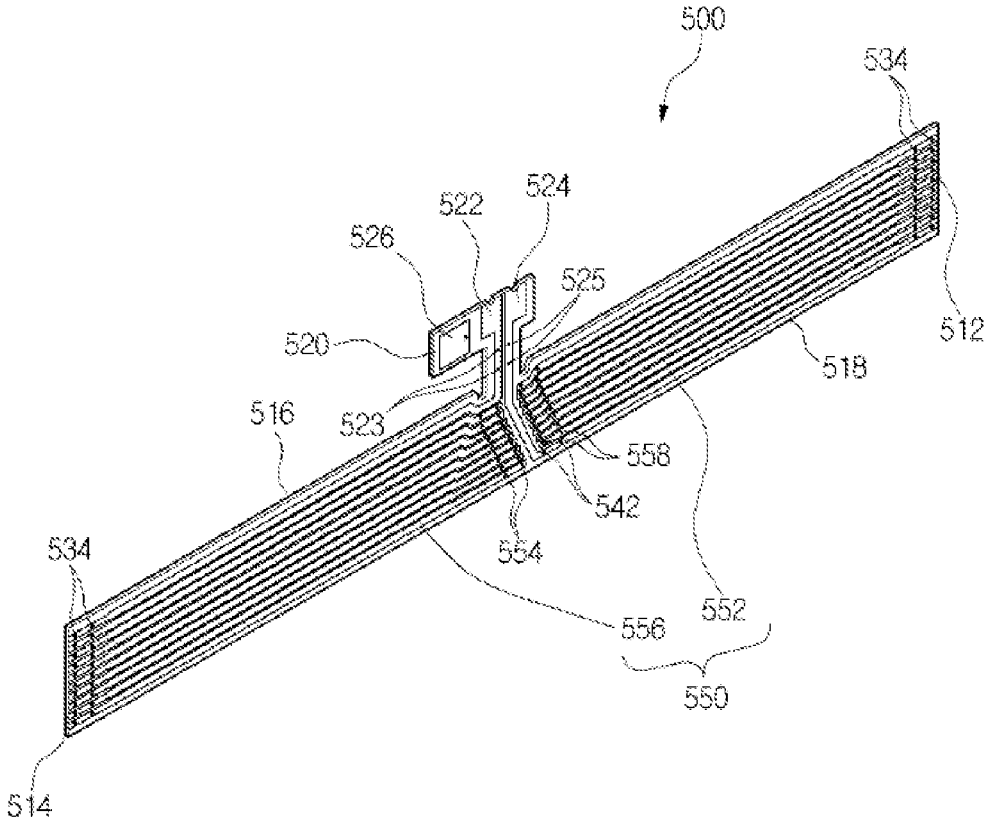

[FIG. 17]
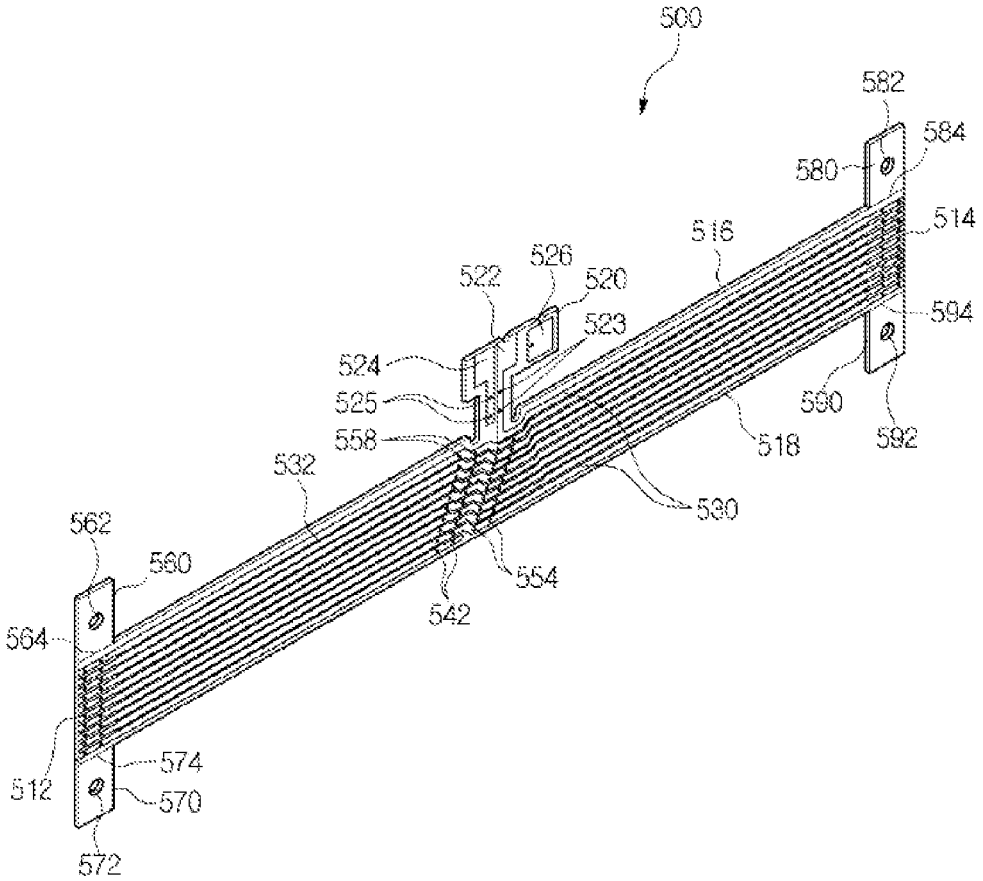

[FIG. 18]
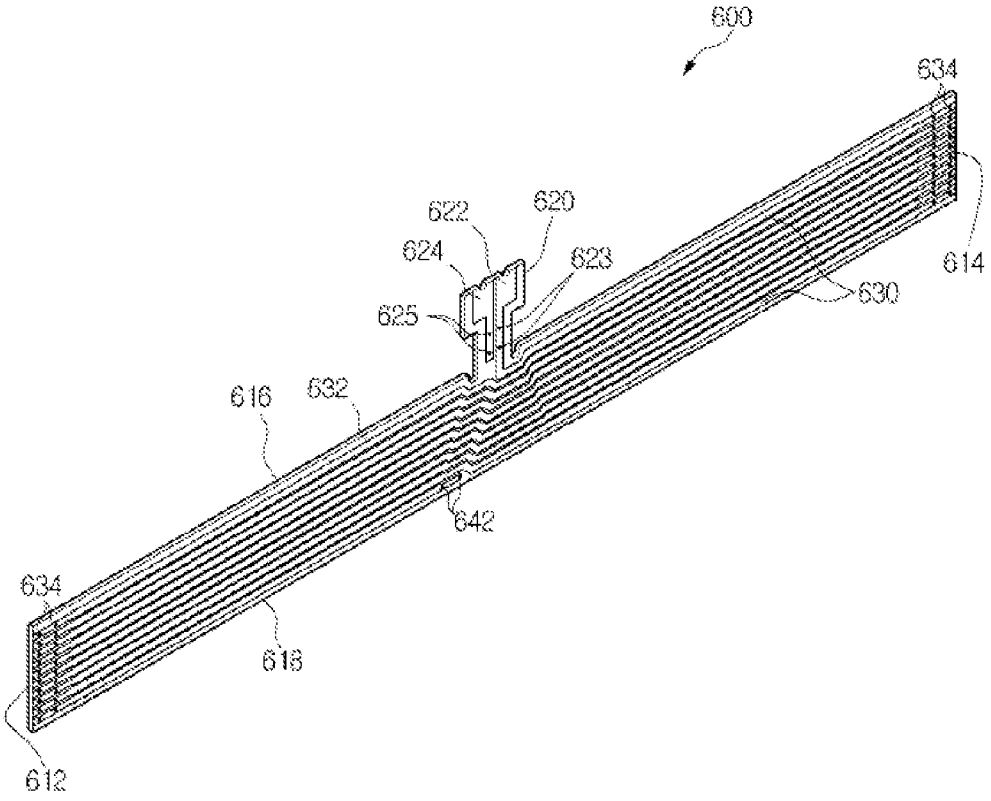

[FIG. 19]
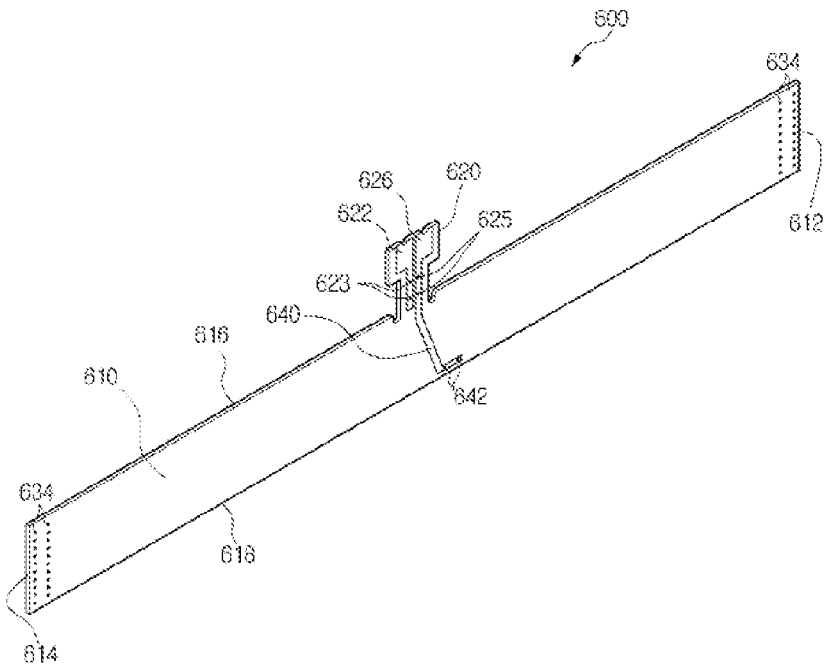
[FIG. 20]
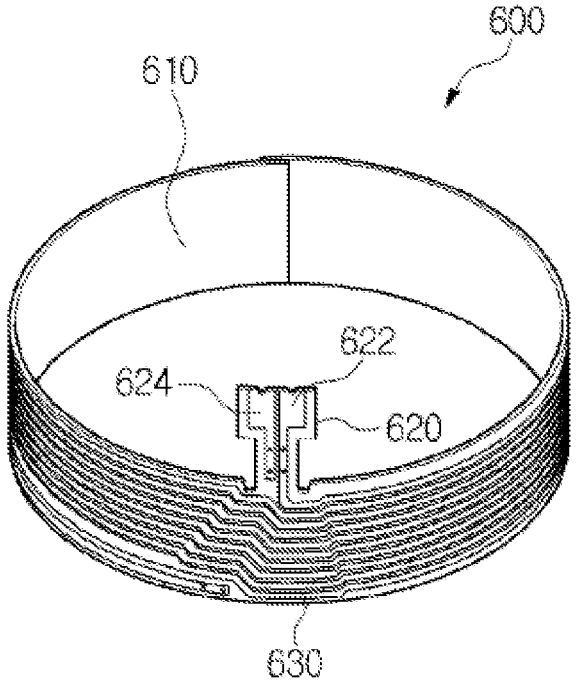

[FIG. 21]
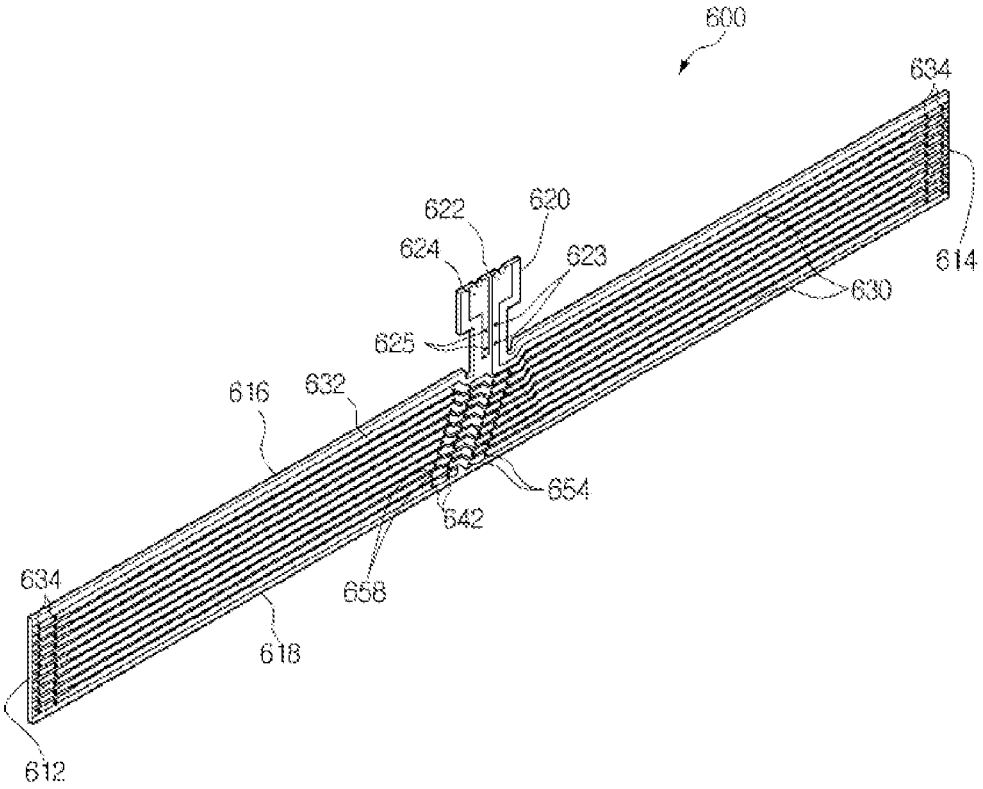

[FIG. 22]
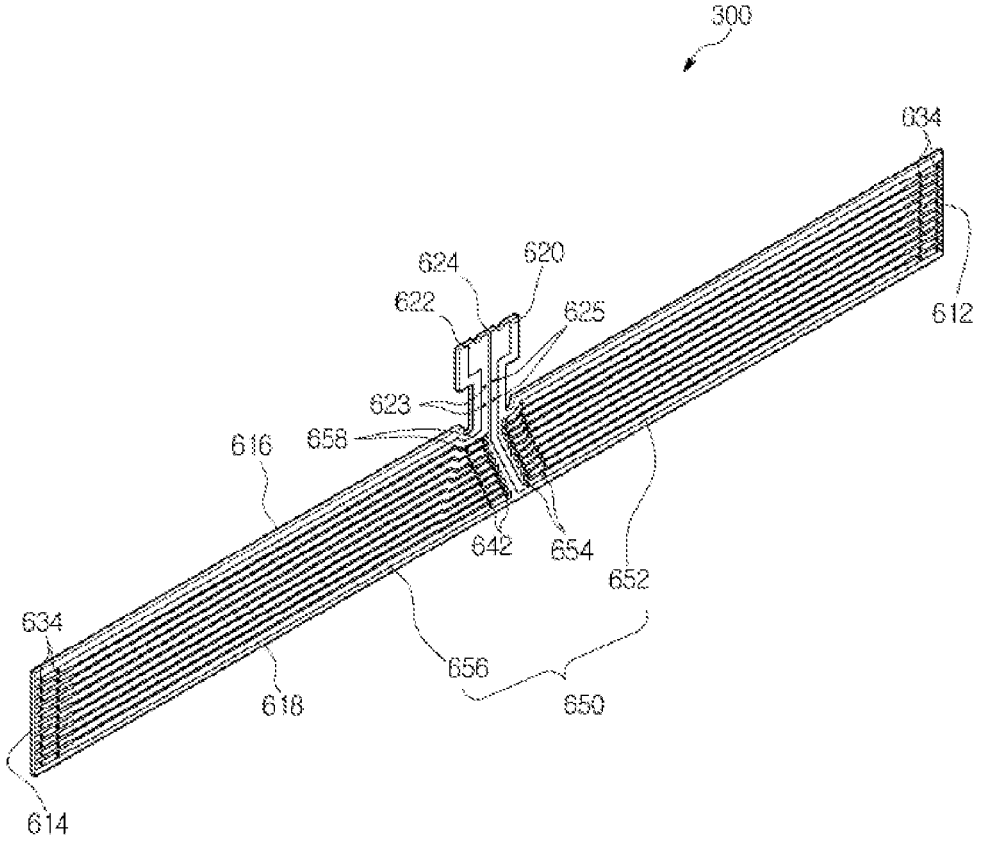

[FIG. 23]
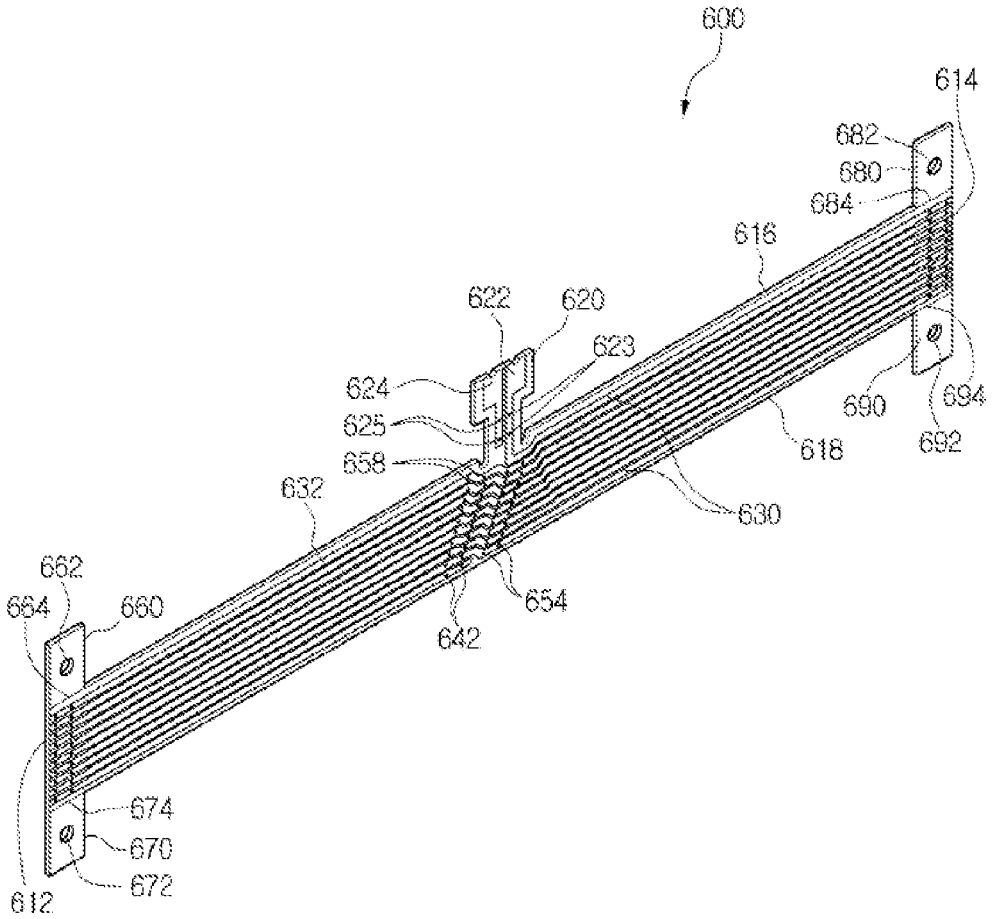

[FIG. 24]
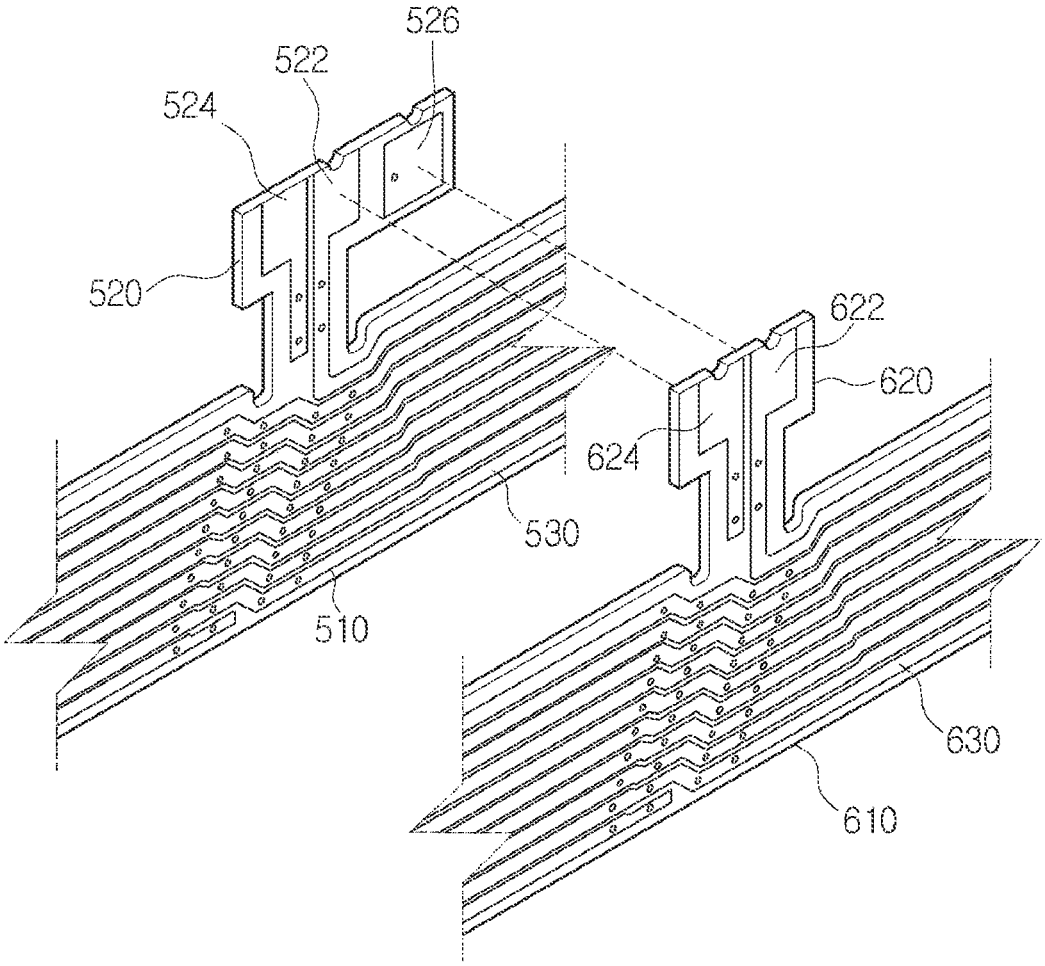

[FIG. 25]
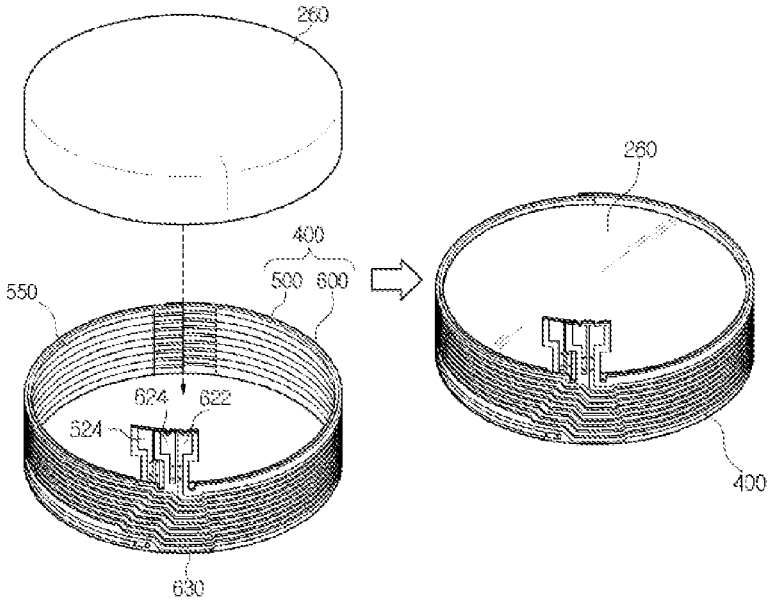
[FIG. 26]
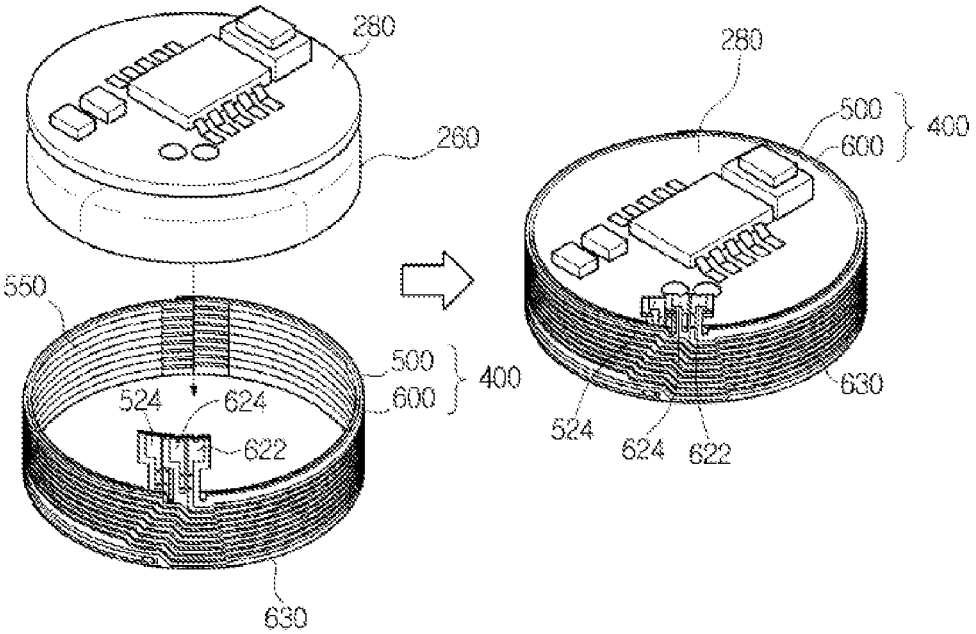

RING-SHAPED ANTENNA AND EARPHONE MODULE HAVING SAME

TECHNICAL FIELD

The present disclosure relates to a ring-shaped antenna, and more particularly, to a ring-shaped antenna for performing communication between earphone modules in a wireless earphone having earphone modules, which are worn on both ears, respectively, and separately configured, and a wireless earphone module having the same.

BACKGROUND ART

An earphone is a device that may be put into an ear to allow a user to listen to sounds such as music and video of a sound source player. The earphone is a sound source device worn on the user's ear, and may be classified into a wired earphone and a wireless earphone module according to a connection method with the sound source player.

The wireless earphone module is composed of a main earphone module for receiving and outputting a sound source from a sound source device through Bluetooth communication and a sub-earphone module for receiving and outputting the sound source from the main earphone module. At this time, the main earphone module and the sub-earphone module are worn on the left ear and the right ear, respectively, and are connected through a cable.

Recently, the wireless earphone module is configured in such a way that the main earphone module and the sub-earphone module, such as Apple's airpod and Samsung's Gear Icon X, are separated to transfer the sound source through Bluetooth communication in order to improve user convenience.

The main earphone module is mounted with two antennas for communication with the sound source device and the sub-earphone module, and the sub-earphone module is mounted with one antenna for communication with the main earphone module.

Since the wireless earphone module is compact, the space capable of mounting the antenna is very narrow, and since the wireless earphone module is located to be spaced apart from the left and the right around a wearer's head, it should be compact and able to communicate through a body (that is, a head).

Accordingly, a directional solenoid antenna in which a wire has been wound around a sintered body is used for the wireless earphone module.

However, there is a problem in that the directional solenoid antenna has a narrow directional angle, thereby rapidly reducing the communication distance according to the fact that the wearer wears the main earphone module and the sub-earphone module alternately, or the wearer's physical condition (for example, the shape of the ear).

In addition, the conventional directional solenoid antenna has a problem in that the sound quality is reduced due to the reduction in the communication distance.

DISCLOSURE

Technical Problem

The present disclosure is intended to solve the above conventional problems, and an object of the present disclosure is to provide a ring-shaped antenna formed in a ring shape mounted between a housing of an earphone module and the outer circumference of a coin-type battery to communicate with an antenna mounted to another earphone module through Near-field magnetic communication (NFMI, near-field magnetic induction type communication or near-field binaural communication), and an earphone module having the same.

In addition, the present disclosure has been proposed considering the above circumstance, and another object of the present disclosure is to provide a double ring-shaped antenna locating a second ring-shaped antenna on the outer circumference of a first ring-shaped antenna to maximize inductance in the same shape and the same size, thereby maximizing antenna performance, and an earphone module having the same.

In addition, still another object of the present disclosure is to provide a double ring-shaped antenna formed in a ring shape mounted between a housing of an earphone module and the outer circumference of a coin-type battery to communicate with another earphone module or a terminal through Near-field magnetic communication (NFMI, near-field magnetic induction type communication or near-field binaural communication), and an earphone module having the same.

Technical Solution

For achieving the objects, a ring-shaped antenna according to a first embodiment of the present disclosure includes a flexible base sheet, a terminal sheet formed to extend from one side of the base sheet, a first terminal formed on one surface of the terminal sheet, a second terminal formed to be spaced apart from the first terminal on one surface of the terminal sheet, and a radiation pattern formed on one surface of the base sheet, one end of the radiation pattern connected with the first terminal, and the other end of the radiation pattern connected with the second terminal.

The terminal sheet may be formed to extend outwards from one selected from a first long side and a second long side of the base sheet.

The radiation pattern may include a plurality of radiation lines formed to be spaced apart from each other on one surface of the base sheet, and a first radiation line among the plurality of radiation lines may have one end connected to the first terminal, and a $n^{th}$ radiation line thereof may have the other end connected to the second terminal.

A second radiation line to a $(n-1)^{th}$ radiation line may have one ends connected to the other ends of the first radiation line to the $(n-2)^{th}$ radiation line, respectively, and have the other ends connected to one ends of a third radiation line to the $n^{th}$ radiation line, respectively, when the base sheet is changed into a ring shape.

The ring-shaped antenna according to the first embodiment of the present disclosure may further include a connection pattern formed on the other surface of the base sheet, one end of the connection pattern connected with the other end of the radiation pattern, and the other end of the connection pattern connected with the second terminal, and a resistor pattern formed on the other surface of the base sheet to be connected with the radiation pattern.

The resistor pattern may include a plurality of first resistor lines located to be spaced apart from each other in a first short side direction of the base sheet and a plurality of second resistor lines located to be spaced apart from each other in a second short side direction of the base sheet, and spaced apart from the first resistor line, and the plurality of first resistor lines and the plurality of second resistor lines may be connected with the radiation line formed on one surface of the base sheet through a via hole.

At this time, one of the plurality of first resistor lines may be connected with the second terminal, and another one of the plurality of second resistor lines may be connected with the first terminal.

The ring-shaped antenna according to the first embodiment of the present disclosure may further include an electrode sheet located on the other surface of the base sheet and an electrode pattern formed on one surface of the electrode sheet. At this time, the long side of the electrode sheet may be formed to be shorter than the long side of the base sheet, the electrode sheet may include a main body part located on the other surface of the base sheet and a protrusion formed to extend from one side facing the terminal sheet, the electrode pattern may be formed over the main body part and the protrusion, and one end of the electrode pattern may be connected with a third terminal formed on the terminal sheet.

For achieving the objects, a ring-shaped antenna according to a second embodiment of the present disclosure, as the ring-shaped antenna mounted to an earphone module, includes a first ring-shaped antenna having a first radiation pattern formed on one surface thereof, and located along the outer circumference of a coin-type battery mounted to the earphone module and a second ring-shaped antenna having a second radiation pattern formed on one surface thereof, and located along the outer circumference of the first ring-shaped antenna.

At this time, the diameter of the first ring-shaped antenna may be formed to be shorter than the diameter of the second ring-shaped antenna.

The first ring-shaped antenna may include a first terminal connected to one end of the first radiation pattern, a second terminal connected to the other end of the first radiation pattern, and a third terminal spaced apart from the first terminal and the second terminal.

The second ring-shaped antenna may include a fourth terminal connected to one end of the second radiation pattern, and connected to the second terminal of the first ring-shaped antenna and a fifth terminal connected to the other end of the second radiation pattern, and connected with the third terminal of the first ring-shaped antenna.

The first terminal and the second terminal may be connected to a circuit board of the earphone module.

One selected from an insulating material, an adhesive agent, and a coverlay may be interposed between the first ring-shaped antenna and the second ring-shaped antenna.

For achieving the objects, a wireless earphone module including a ring-shaped antenna according to an embodiment of the present disclosure may include a housing, a coin-type battery received in the housing, and a ring-shaped antenna of claim 1 located between the outer circumference of the coin-type battery and the housing.

The wireless earphone module may further include a circuit board received inside the ring-shaped antenna and located on the upper portion of the coin-type battery, and a terminal sheet of the ring-shaped antenna may be bent inwards to be connected to the circuit board.

The electrode sheet of the ring-shaped antenna may be bent inwards to be connected to the terminal of the coin-type battery.

Advantageous Effects

According to the present disclosure, it is possible for the ring-shaped antenna to be formed in a ring shape mounted between the housing of the earphone module and the outer circumference of the coin-type battery to communicate with the antenna mounted to another earphone module through the Near-field magnetic communication (NFMI, near-field magnetic induction type communication or near-field binaural communication), thereby maximizing the Quality Factor and the antenna performance by increasing the area of the radiation pattern compared to the conventional antenna winding the radiation pattern around the sintered body.

In addition, it is possible for the ring-shaped antenna to be formed in a ring shape mounted between the housing of the earphone module and the outer circumference of the coin-type battery to communicate with the antenna mounted to another earphone module through the NFMI, thereby minimizing the influence of the electromagnetic wave on the human body by using the band of 10 MHz that is a relatively low frequency compared to Bluetooth of the band of 2.4 GHz.

In addition, it is possible for the ring-shaped antenna to be formed in a ring shape mounted between the housing of the earphone module and the outer circumference of the coin-type battery, thereby increasing the communication distance compared to the conventional antenna of the sintered body winding structure, and implementing the communication distance of a certain level (about 25 cm) or more regardless of directionality.

In addition, it is possible for the ring-shaped antenna to be formed in a ring shape mounted between the housing of the earphone module and the outer circumference of the coin-type battery to communicate with the antenna mounted to another earphone module through the NFMI, thereby providing the communication distance of a certain level or more even in the fact that the wearer wears the main earphone module and the sub-earphone module alternately, or the physical condition of the wearer (for example, the shape of the ear).

In addition, it is possible for the ring-shaped antenna to be formed in a ring shape mounted between the housing of the earphone module and the outer circumference of the coin-type battery to communicate with the antenna mounted to another earphone module through the NFMI to provide the communication distance of a certain level or more, thereby providing the sound quality of a certain level or more.

In addition, it is possible for the ring-shaped antenna to form the guide sheet extending from the base sheet, thereby aligning both ends of the radiation pattern at the accurate location when changed into a ring shape.

In addition, it is possible for the ring-shaped antenna to form the perforation at the portion where the guide sheet and the base sheet are connected to each other, thereby easily removing the unnecessary guide sheet when mounted to the ring-shaped wearable device.

In addition, it is possible for the ring-shaped antenna to vary the coupling location between the guide holes to deform the base sheet into the ring shape, thereby easily changing the size (diameter) of the ring-shaped antenna.

In addition, it is possible for the ring-shaped antenna to perform the change in size through a variation of the coupling location between both ends of the radiation pattern, thereby manufacturing the ring-shaped antenna module having various sizes by using the plane-shaped antenna module formed in a single standard.

In addition, it is possible for the ring-shaped antenna to locate the second ring-shaped antenna on the outer circumference of the first ring-shaped antenna, thereby maximizing the Quality Factor and the antenna performance by increasing the area of the radiation pattern compared to the conventional antenna winding the radiation pattern around the sintered body.

In addition, it is possible for the ring-shaped antenna to locate the second ring-shaped antenna on the outer circumference of the first ring-shaped antenna, thereby maximizing the antenna performance by maximizing inductance in the same shape and the same size. That is, the ring-shaped antenna may increase the radiation area compared to the conventional antenna, thereby maximizing the recognition distance and the communication performance of the antenna.

In addition, it is possible for the ring-shaped antenna to be formed in the ring shape mounted between the housing of the wireless earphone module and the outer circumference of the coin-type battery to communicate with the earphone module or the terminal through the NFMI, thereby increasing the communication distance compared to the conventional antenna for performing the Bluetooth band communication of the band of 2.4 GHz, and implementing the communication distance of a certain level (about 25 cm) or more regardless of directionality.

DESCRIPTION OF DRAWINGS

FIG. 1 is a diagram for explaining a ring-shaped antenna according to a first embodiment of the present disclosure.

FIGS. 2 to 4 are diagrams for explaining a configuration of the ring-shaped antenna according to the first embodiment of the present disclosure.

FIGS. 5 and 6 are diagrams for explaining a modification example of the ring-shaped antenna according to the first embodiment of the present disclosure.

FIG. 7 is a diagram for explaining another modification example of the ring-shaped antenna according to the first embodiment of the present disclosure.

FIGS. 8 and 9 are diagrams for explaining the ring-shaped antenna according to the first embodiment of the present disclosure.

FIG. 10 is a diagram for explaining a modification example of the ring-shaped antenna according to the first embodiment of the present disclosure.

FIG. 11 is a diagram for explaining a double ring-shaped antenna according to a second embodiment of the present disclosure.

FIGS. 12 to 17 are diagrams for explaining a first ring-shaped antenna of FIG. 11.

FIGS. 18 to 23 are diagrams for explaining a second ring-shaped antenna of FIG. 11.

FIG. 24 is a diagram for explaining a double ring-shaped antenna according to the second embodiment of the present disclosure.

FIGS. 25 and 26 are diagrams for explaining an earphone module having the double ring-shaped antenna according to the second embodiment of the present disclosure.

BEST MODE

Hereinafter, the most preferred embodiments of the present disclosure will be described in detail with reference to the accompanying drawings so that those skilled in the art to which the present disclosure pertains may easily carry out the technical spirit of the present disclosure. First, in adding reference numerals to the components of each drawing, it should be noted that the same components have the same reference numerals as much as possible even if they are displayed on different drawings. In addition, in describing the present disclosure, when it is determined that the detailed description of the related well-known configuration or function may obscure the gist of the present disclosure, the detailed description thereof will be omitted.

Referring to FIG. 1, a ring-shaped antenna 100 according to a first embodiment of the present disclosure is formed in a ring shape and mounted to a main earphone module 220 and a sub-earphone module 240 of a wireless earphone module 200.

The ring-shaped antenna 100 operates as an antenna for communication between the main earphone module 220 and the sub-earphone module 240. At this time, the ring-shaped antenna 100 operates as a Near-field magnetic communication (NFMI) antenna (that is, near-field magnetic induction method) for resonating in a frequency band of about 10 MHz.

In FIG. 1, although it has been described that the ring-shaped antenna is mounted to the main earphone module 220 and the sub-earphone module 240 of the wireless earphone module 200 as an example, it is not limited thereto and may also be mounted to a hearing aid, a smart watch, etc. requiring near-field communication between an apparatus or a module.

Referring to FIGS. 2 and 3, the ring-shaped antenna 100 according to the first embodiment of the present disclosure includes a base sheet 110, a terminal sheet 120, a radiation pattern 130, and a connection pattern 140.

The base sheet 110 is formed of a flexible printed circuit board (FPCB). That is, since the ring-shaped antenna 100 is formed in a ring shape, the base sheet 110 is made of a flexible material that is easy to process into a ring shape. At this time, since the base sheet 110 is formed in a ring shape, the base sheet 110 may have a rectangular shape having a first short side 112, a second short side 114, a first long side 116, and a second long side 118.

The terminal sheet 120 is formed to extend from one side of the base sheet 110. That is, the terminal sheet 120 is formed to extend outwards from the first long side 116 or the second long side 118 of the base sheet 110.

At this time, the first terminal 122 and the second terminal 124 connected with the radiation pattern 130 are located to be spaced apart from each other in the terminal sheet 120.

The first terminal 122 is formed on one surface of the terminal sheet 120 to be connected with one end of the radiation pattern 130. At this time, the first terminal 122 may be composed of a pair of terminals formed on both surfaces of the terminal sheet 120, respectively. Here, the pair of terminals formed on both surfaces of the terminal sheet 120, respectively are connected through the via hole 126 to constitute the first terminal 122.

The second terminal 124 is formed to be spaced apart from the first terminal 122 on one surface of the terminal sheet 120 to be connected with the other end of the radiation pattern 130. At this time, the second terminal 124 may be composed of a pair of terminals formed on both surfaces of the terminal sheet 120, respectively. Here, the pair of terminals formed on both surfaces of the terminal sheet 120, respectively are connected through the via hole 128 to constitute the second terminal 124.

The first terminal 122 and the second terminal 124 are connected to the terminal formed on the circuit board of the wireless earphone module 200, respectively when the ring-shaped antenna 100 is mounted.

The radiation pattern 130 is located on one surface (that is, the upper surface) of the base sheet 110. The radiation pattern 130 is composed of a plurality of radiation lines 132 located on one surface of the base sheet 110. The plurality of radiation lines 132 are located on one surface of the base sheet 110 through processes such as deposition, printing, and plating. At this time, the plurality of radiation lines 132 are made of a metal material such as copper, aluminum, or silver, and located to be spaced apart from each other.

One of the plurality of radiation lines 132 has one end connected with the first terminal 122, and has the other end connected with the other radiation line 132. The other one of the plurality of radiation lines 132 has one end connected with another radiation line 132, and has the other end connected with the second terminal 124. At this time, the remaining radiation lines 132 have both ends connected to the other radiation line 132, respectively.

For example, when the radiation pattern 130 is composed of the first radiation line 132 to the $n^{th}$ radiation line 132, the first radiation line 132 has one end connected with the first terminal 122, and has the other end connected with the second radiation line 132. The second radiation line 132 to the $(n-1)^{th}$ radiation line 132 has one end connected with the previous radiation lines 132 (that is, the first radiation line 132 to the $(n-2)^{th}$ radiation line 132), and has the other end connected with the next radiation line (that is, the third radiation line 132 to the $n^{th}$ radiation line 132). The $n^{th}$ radiation line 132 has one end connected to the $(n-1)^{th}$ radiation line 132, and has the other end connected with the second terminal 124 through the connection pattern 140.

The connection pattern 140 is formed on the other surface of the base sheet 110. The connection pattern 140 has one end connected with one of the plurality of radiation lines 132, and has the other end connected with the second terminal 124. At this time, the connection pattern 140 has one end connected with the radiation line 132 through the via hole 142, and has the other end connected with the second terminal 124 formed on the other surface of the terminal sheet 120.

Here, although it has been shown and described in FIG. 3 that the connection pattern 140 is formed on the other surface (that is, the lower surface) of the base sheet 110, it is not limited thereto, and the base sheet 110 is formed to have a two-layer structure, and the radiation pattern 130 and the connection pattern 140 may also be formed on sheets different from each other.

Referring to FIG. 4, both ends of the radiation pattern 130 are connected to the ring-shaped antenna 100 of the above-described configuration as the ring-shaped antenna 100 is changed from a planar state into a ring shape. At this time, a protective sheet (not shown) is formed on both surfaces of the base sheet 110 so that a portion of both ends of the radiation pattern 130 is exposed to the outside, and both ends of the radiation pattern 130 are electrically connected to each other through the via hole 134.

Accordingly, the radiation pattern 130 forms an antenna of a helical structure wound along the outer circumference of the base sheet 110 changed into a ring shape.

Since the ring-shaped antenna 100 should be manufactured in different sizes according to the size of the wireless earphone module 200 to be installed, the size of the ring-shaped antenna 100 may be adjusted by adjusting a location where both ends of the radiation pattern 130 are coupled.

Referring to FIGS. 5 and 6, the ring-shaped antenna 100 may further include a resistor pattern 150 formed on the other surface of the base sheet 110.

If the ring-shaped antenna 100 has only the radiation pattern 130 formed on one surface of the base sheet 110, the ring-shaped antenna 100 may have a high resistance value, thereby reducing a Quality Factor.

When the Quality Factor is reduced, the antenna performance of the ring-shaped antenna 100 is reduced, such that the ring-shaped antenna 100 should provide the Quality Factor of a certain level or more.

Referring to the following Equation 1, factors for determining the Quality Factor (Q) include an inductance (L) and a resistance (R). Where $w_o$ refers to a resonance angle frequency.

$$Q = \frac{w_0 L}{R} \qquad \text{Equation 1}$$

At this time, since the Quality Factor of the ring-shaped antenna 100 is inversely proportional to the resistance, it is possible to increase the area of the radiation pattern 130 to reduce the resistance, thereby increasing the Quality Factor.

Accordingly, the ring-shaped antenna 100 forms a resistor pattern 150 on the other surface of the base sheet 110, and connects the resistor pattern 150 with the radiation pattern 130 formed on one surface of the base sheet 110 to reduce the resistance of the radiation pattern 130. At this time, the resistor pattern 150 may be made of a metal material such as copper, aluminum, or silver.

The resistor pattern 150 may be composed of a plurality of first resistor lines 152 located on the first short side 112 direction and a plurality of second resistor lines 154 located on the second short side 114 direction with respect to the connection pattern 140 formed on the lower surface of the base sheet 110.

The first resistor line 152 has one end portion connected with the radiation line 132 through the via hole 134, and has the other end portion connected with the radiation line 132 through the via hole 156. At this time, the other end portion of the first resistor line 152 is located to be spaced at a predetermined interval apart from the connection pattern 140 formed on the other surface of the base sheet 110, and connected with the radiation line 132 through the via hole 156. At this time, one of the plurality of first resistor lines 152 has the other end portion connected with the connection pattern 140.

The second resistor line 154 has one end portion connected with the radiation line 132 through the via hole 158, and has the other end portion connected with the radiation line 132 through the via hole 134. At this time, one end portion of the second resistor line 154 is located to be spaced at a predetermined interval apart from the connection pattern 140 formed on the other surface of the base sheet 110, and connected with the radiation line 132 through the via hole 156. At this time, one of the plurality of second resistor lines 154 has one end portion extended to the terminal sheet 120 to be connected with the first terminal 122.

Here, the first resistor line 152 and the second resistor line 154 may be formed variously in a length, the number thereof, an area, etc. according to the required Quality Factor, and only any one of the first resistor line 152 and the second resistor line 154 may also be formed.

Referring to FIG. 7, the ring-shaped antenna 100 may further include a guide sheet for guiding a coupling location when the changed from a planar state into a ring shape. For example, the guide sheet may further include the first guide sheet 160 to the fourth guide sheet 190.

The first guide sheet 160 is formed on one side portion of the first long side 116 of the base sheet 110. The first guide sheet 160 is made of the same material as that of the base sheet 110, and formed to extend outwards from one side portion of the first long side 116 direction (that is, the first short side 112 direction) of the base sheet 110. At this time, the first guide sheet 160 is formed with a first guide hole 162 for coupling to the jig for manufacturing (not shown) used to couple the ring-shaped antenna 100 in a ring shape.

The first guide sheet 160 is removed after coupling the ring-shaped antenna 100 in a ring shape, and for this purpose, a plurality of holes for perforating the first guide sheet 160 are formed in a portion connected with the base sheet 110 to form a first perforation 164. Here, as long as the first guide sheet 160 may be removed from the base sheet 110, various modifications may be made in addition to the first perforation 164.

The second guide sheet 170 is formed on one side portion of the second long side 118 of the base sheet 110. The second guide sheet 170 may be made of the same material as that of the base sheet 110, and formed to extend outwards from one side portion of the second long side 118 direction (that is, the first short side 112 direction) of the base sheet 110. At this time, the second guide sheet 170 is formed with one or more second guide holes 172 for coupling to the jig for manufacturing (not shown) used to couple the ring-shaped antenna 100 in a ring shape.

The second guide sheet 170 is removed after coupling the ring-shaped antenna 100 in a ring shape, and for this purpose, a plurality of holes for perforating the second guide sheet 170 are formed in a portion connected with the base sheet 110 to form a second perforation 174. Here, as long as the second guide sheet 170 may be removed from the base sheet 110, various modifications may be made in addition to the second perforation 174.

The third guide sheet 180 is formed on the other side portion of the first long side 116 of the base sheet 110. The third guide sheet 180 is made of the same material as that of the base sheet 110, and formed to extend outwards from the other side portion of the first long side 116 direction (that is, the second short side 114 direction) of the base sheet 110. At this time, the third guide sheet 180 is formed with one or more third guide holes 182 for coupling to the jig for manufacturing (not shown) used to couple the ring-shaped antenna 100 in a ring shape.

The third guide sheet 180 is removed after coupling the ring-shaped antenna 100 in a ring shape, and for this purpose, a plurality of holes for perforating the third guide sheet 180 are formed in a portion connected with the base sheet 110 to form a third perforation 184. Here, as long as the third guide sheet 180 may be removed from the base sheet 110, various modifications may be made in addition to the third perforation 184.

The fourth guide sheet 190 is formed on the other side portion of the second long side 118 of the base sheet 110. The fourth guide sheet 190 is made of the same material as that of the base sheet 110, and formed to extend outwards from the other side portion of the second long side 118 direction (that is, the second short side 114 direction) of the base sheet 110. At this time, the fourth guide sheet 190 is formed with one or more fourth guide holes 192 for coupling to the jig for manufacturing (not shown) used to couple the ring-shaped antenna 100 in a ring shape.

The fourth guide sheet 190 is removed after coupling the ring-shaped antenna 100 in a ring shape, and for this purpose, a plurality of holes for perforating the fourth guide sheet 190 are formed in a portion connected with the base sheet 110 to form a fourth perforation 194. Here, as long as the fourth guide sheet 190 may be removed from the base sheet 110, various modifications may be made in addition to the fourth perforation 194.

As described above, the ring-shaped antenna 100 may form the guide sheets 160, 170, 180, 190 extending from the base sheet 110, thereby aligning both ends of the radiation pattern 130 at the accurate location when changed into a ring shape.

In addition, the ring-shaped antenna 100 may form the perforations 164, 174, 184, 194 on the portions where the guide sheet and the base sheet 110 are connected to each other, thereby easily removing the unnecessary guide sheets 160, 170, 180, 190 when mounted to a ring-shaped wearable device.

In addition, the ring-shaped antenna 100 may vary the coupling location of the guide holes 162, 172, 182, 192 to change the base sheet 110 into a ring shape, thereby easily changing the size (diameter) of the ring-shaped antenna 100.

In addition, the ring-shaped antenna 100 may perform a change in the size through a variation of the coupling location between the both ends of the radiation pattern 130, thereby manufacturing a ring-shaped antenna module having various sizes by using a planar-shaped antenna module formed in a single standard.

Referring to FIG. 8, the ring-shaped antenna 100 is located on the outer circumference of the coin-type battery 260 mounted to the earphone module (that is, the main earphone module 220 and the sub-earphone module 240). That is, the ring-shaped antenna 100 is located so that the inner circumference thereof surrounds the side surface outer circumference of the coin-type battery 260 received in the earphone modules 220 and 240. At this time, the ring-shaped antenna 100 may further include a magnetic sheet (not shown) located on the other surface (that is, the surface facing the side surface outer circumference of the coin-type battery 260). Here, the magnetic sheet is composed of a ferrite sheet, a flexible polymer sheet, etc., and located on the other surface of the base sheet on which the resistor pattern has been formed.

The ring-shaped antenna 100 may also be located between the outer circumference of the coin-type battery 260 and the housing of the earphone module. That is, the ring-shaped antenna 100 may be located so that the inner circumference thereof surrounds the side surface outer circumference of the coin-type battery 260 and the outer circumference thereof is adjacent to the inner wall surface of the housing.

The ring-shaped antenna 100 is connected with the circuit board through the terminal sheet 120. That is, the terminal sheet 120 is bent outwards from the ring-shaped antenna 100, and the first terminal 122 and the second terminal 124 formed on the terminal sheet 120 are connected to the circuit board located outside the ring-shaped antenna 100. At this time, the first terminal 122 and the second terminal 124 may be electrically connected to the circuit board through soldering, or electrically connected to the circuit board through a conductive adhesive.

Referring to FIG. 9, the ring-shaped antenna 100 may also be located on the outer circumference of the coin-type battery 260 and the circuit board 180 of the earphone modules 220 and 240. That is, the ring-shaped antenna 100 is located so that the inner circumference thereof surrounds the outer circumference of the coin-type battery 260 and the outer circumference of the circuit board 280 located on one surface of the coin-type battery 260.

The ring-shaped antenna 100 is connected with the circuit board 280 through the terminal sheet 120. That is, the terminal sheet 120 is bent inwards from the ring-shaped antenna 100, and the first terminal 122 and the second terminal 124 formed on the terminal sheet 120 are connected to the circuit board 280 located inside the ring-shaped antenna 100. At this time, the first terminal 122 and the second terminal 124 may be electrically connected to the circuit board 280 through soldering, or electrically connected to the circuit board 280 through a conductive adhesive.

Referring to FIG. 10, the ring-shaped antenna 100 may further include an electrode sheet 320 and an electrode pattern 340.

The electrode sheet 320 is located on the other surface of the base sheet 110. The long side of the electrode sheet 320 is formed to be shorter than the long side of the base sheet 110 so that both ends of the base sheet 110 are exposed to the outside.

The electrode sheet 320 includes a base part 322 located on the other surface of the base sheet 110, a first protrusion 324 extending outwards from one long side of the base part 322, and a second protrusion 326 extending outwards from the other long side of the base part 322.

The first protrusion 324 is formed at one side corresponding to the terminal sheet 120 to be located on the other surface of the terminal sheet 120.

The second protrusion 326 is formed to extend from one side facing the terminal sheet 120. At this time, a fourth terminal 360 is formed on the second protrusion 326. At this time, the second protrusion 326 is bent in the inner circumferential direction of the ring-shaped antenna 100 to be located on one surface of the coin-type battery 260. Here, the fourth terminal 360 is connected with an electrode (that is, a (−) electrode or a (+) electrode) of the coin-type battery 260 received in the inner circumference of the ring-shaped antenna 100.

The electrode pattern 340 is formed on one surface of the electrode sheet 320. At this time, the electrode pattern 340 is formed over the base part 322, the first protrusion 324, and the second protrusion 326. Here, one end of the electrode pattern 340 formed on one surface of the first protrusion 324 is connected with the third terminal 126 formed in the terminal sheet 120 through the via hole 382, and the other end of the electrode pattern 340 formed on one surface of the second protrusion 326 is connected with the fourth terminal 360 through the via hole 384.

Accordingly, the ring-shaped antenna 100 increases the area of the radiation pattern 130 compared to the conventional antenna winding the radiation pattern 130 around the sintered body, thereby maximizing the Quality Factor and the antenna performance. That is, the ring-shaped antenna 100 may provide the communication distance of a certain level or more even in the physical condition of the wearer (for example, the shape of the ear), increase the communication distance compared to the conventional antenna of the winding structure of the sintered body, and provide the sound quality of a certain level by implementing the communication distance of a certain level (about 25 cm) or more regardless of the directionality.

In addition, the ring-shaped antenna 100 minimizes the influence of the electromagnetic wave on the human body by using the NFMI in the band of 10 MHz, which is a relatively low frequency, compared to Bluetooth in the band of 2.4 GHz.

Referring to FIG. 10, the ring-shaped antenna 400 according to a second embodiment of the present disclosure is formed as a structure of locating a second ring-shaped antenna 600 on the outer circumference of a first ring-shaped antenna 500 in order to maximize an inductance in the same shape and the same size.

The ring-shaped antenna is mounted inside the earphone module of the wireless earphone or the hearing aid. The ring-shaped antenna operates as an antenna for communication with the other earphone module when mounted to the earphone module of the wireless earphone, and operates as an antenna for communication with the terminal when mounted to the earphone module of the hearing aid. At this time, the ring-shaped antenna operates as a Near-field magnetic communication (NFMI, that is, near-field magnetic induction method) antenna for resonating in a frequency band of about 10 MHz.

For this purpose, the diameter (d1) of the first ring-shaped antenna 500 is formed to be larger than the diameter (d2) of the second ring-shaped antenna 600. At this time, an insulating material, an adhesive agent, a coverlay, etc. for insulation may be located between the first ring-shaped antenna 500 and the second ring-shaped antenna 600.

As a result, the ring-shaped antenna 400 may implement a relatively high inductance in the same shape and the same size as those of the right-shaped antenna of the single layer structure, thereby maximizing the antenna performance and the recognition distance.

The first ring-shaped antenna 500 is formed in a ring shape having a pair of long sides and a pair of short sides that connect the short sides to have the first diameter (d1).

Referring to FIGS. 12 and 13, the first ring-shaped antenna 500 includes a first base sheet 510, a first terminal sheet 520, a first radiation pattern 530, and a first connection pattern 540.

The first base sheet 510 is formed of a flexible printed circuit board (FPCB). That is, since the first ring-shaped antenna 500 is formed in a ring shape, the first base sheet 510 is formed of a flexible material that is easy to process into a ring shape. At this time, since the first base sheet 510 is formed in a ring shape, the first base sheet 510 may have a rectangular shape having a first short side 512, a second short side 514, a first long side 516, and a second long side 518.

The first terminal sheet 520 is formed to extend from one side of the first base sheet 510. The first terminal sheet 520 is formed to extend outwards from the first long side 516 or the second long side 518 of the first base sheet 510.

At this time, the first terminal 522, the second terminal 524, and the third terminal 526 connected with the radiation pattern are located to be spaced apart from each other in the first terminal sheet 520.

The first terminal 522 is formed on one surface of the first terminal sheet 520 to be connected with one end of the first radiation pattern 530. At this time, the first terminal 522 may be composed of a pair of terminals formed on both surfaces of the first terminal sheet 520, respectively. Here, the pair of terminals formed on both surfaces of the first terminal sheet 520, respectively are connected through the via hole 523 to constitute the first terminal 522.

The second terminal 524 is formed to be spaced apart from the first terminal 522 on one surface of the first terminal sheet 520 to be connected with the other end of the first radiation pattern 530. At this time, the second terminal 524 may be composed of a pair of terminals formed on both surfaces of the first terminal sheet 520, respectively. Here, the pair of terminals formed on both surfaces of the first terminal sheet 520, respectively are connected through the via hole 525 to constitute the second terminal 524.

The third terminal 526 is formed to be spaced apart from the first terminal 522 and the second terminal 524 on one surface of the first terminal sheet 520. At this time, the third terminal 526 may be composed of a pair of terminals formed on both surfaces of the first terminal sheet 520, respectively. Here, a pair of terminals formed on both surfaces of the first terminal sheet 520, respectively are connected through a via hole (not shown) to constitute a third terminal 526.

The first terminal 522 and the third terminal 526 are connected to the terminal formed on the circuit board of the earphone module, respectively, when the first ring-shaped antenna 500 is mounted.

The first radiation pattern 530 is located on one surface (that is, upper surface) of the first base sheet 510. The first radiation pattern 530 is composed of a plurality of radiation lines 532 located on one surface of the first base sheet 510. The plurality of radiation lines 532 are located on one surface of the first base sheet 510 through processes such as deposition, printing, and plating. At this time, the plurality of radiation lines 532 are made of a metal material such as copper, aluminum, or silver, and located to be spaced apart from each other.

For example, when the first radiation pattern 530 is composed of a first radiation line to a $n^{th}$ radiation line, the first radiation line has one end connected with the first terminal 522, and has the other end connected with the second radiation line. The second radiation line to the $(n-1)^{th}$ radiation line has one end connected with the previous radiation lines (that is, the first radiation line to the $(n-2)^{th}$ radiation line), and has the other end connected with the next radiation line (that is, the third radiation line to the $n^{th}$ radiation line). The $n^{th}$ radiation line has one end connected with the $(n-1)^{th}$ radiation line, and has the other end connected with the second terminal 524 through a connection pattern.

The first connection pattern 540 is formed on the other surface of the first base sheet 510. The first connection pattern 540 has one end connected with one of the plurality of radiation lines 532, and has the other end connected with the second terminal 524. At this time, the first connection pattern 540 has one end connected with the radiation line 532 through the via hole 542, and has the other end connected with the second terminal 524 formed on the other surface of the first terminal sheet 520 through the via hole 515. Accordingly, the first connection pattern 540 connects the other end of the second radiation pattern 530 to the second terminal 524.

Here, although it has been shown and described in FIG. 13 that the first connection pattern 540 is formed on the other surface (that is, the lower surface) of the first base sheet 510, it is not limited thereto, and the first base sheet 510 is formed to have a 2 Layer structure, and the first radiation pattern 530 and the first connection pattern 540 may also be formed on sheets different from each other.

Referring to FIG. 14, both ends of the first radiation pattern 530 are connected as the first ring-shaped antenna 500 of the above-described configuration is changed from a planar state into a ring shape. At this time, a protective sheet (not shown) is formed on both surfaces of the first base sheet 510 so that a portion of both ends of the first radiation pattern 530 is exposed to the outside, and both ends of the first radiation pattern 530 are electrically connected through the via hole 534.

Accordingly, the first radiation pattern 530 forms an antenna of a helical structure wound along the outer circumference of the first base sheet 510 changed into a ring shape.

Since the first ring-shaped antenna 500 should be manufactured to have the sizes different from each other according to the size of the earphone module to be installed, the size of the first ring-shaped antenna 500 may be adjusted by adjusting the location where both ends of the first radiation pattern 530 are coupled.

Referring to FIGS. 15 and 16, the first ring-shaped antenna 500 may further include a first resistor pattern 550 formed on the other surface of the first base sheet 510.

When the first ring-shaped antenna 500 has only the first radiation pattern 530 formed on one surface of the first base sheet 510, the first ring-shaped antenna 500 may have a high resistance value, thereby reducing the Quality Factor.

When the Quality Factor is reduced, the antenna performance of the first ring-shaped antenna 500 is reduced, such that the first ring-shaped antenna 500 should provide the Quality Factor of a certain level or more. Factors that determine the Quality Factor (Q) include an inductance (L) and a resistance (R).

At this time, since the Quality Factor of the first ring-shaped antenna 500 is inversely proportional to the resistance, it is possible to increase the area of the first radiation pattern 530 to reduce the resistance, thereby increasing the Quality Factor.

Accordingly, the first ring-shaped antenna 500 forms the first resistor pattern 550 on the other surface of the first base sheet 510, and connects the first resistor pattern 550 with the first radiation pattern 530 formed on one surface of the first base sheet 510, thereby reducing the resistance of the first radiation pattern 530. At this time, the first resistor pattern 550 may be made of a metal material such as copper, aluminum, or silver.

The first resistor pattern 550 is composed of a plurality of first resistor lines 552 located on the first short side 512 direction and a plurality of second resistor lines 554 located on the second short side 514 direction with respect to the first connection pattern 540 formed on the lower surface of the first base sheet 510.

The first resistor line 552 has one end portion connected with the radiation line 532 through the via hole 534, and has the other end portion connected with the radiation line 532 through the via holes 542, 258. At this time, the other end portion of the first resistor line 552 is located to be spaced at a predetermined interval apart from the first connection pattern 540 formed on the other surface of the first base sheet 510, and connected with the radiation line 532 through the via holes 542, 258. At this time, one of the plurality of first resistor lines 552 has the other end portion connected with the first connection pattern 540.

The second resistor line 554 has one end portion connected with the radiation line 532 through the via hole 558, and has the other end portion connected with the radiation line 532 through the via hole 534. At this time, one end portion of the second resistor line 554 is located to be spaced at a predetermined interval apart from the first connection pattern 540 formed on the other surface of the first base sheet 510, and connected with the radiation line 532 through the via hole 558. At this time, one of the plurality of second resistor lines 554 has one end portion extended to the first terminal sheet 520 to be connected with the first terminal 522.

Here, the first resistor line 552 and the second resistor line 554 may be formed variously in a length, the number thereof, an area, etc. according to the required Quality Factor, and only any one of the first resistor line 552 and the second resistor line 554 may also be formed.

Referring to FIG. 17, the first ring-shaped antenna 500 may further include a guide sheet for guiding a coupling location when changed from a planar state into a ring shape. For example, the guide sheet may further include the first guide sheet 560 to the fourth guide sheet 590.

The first guide sheet 560 is formed on one side portion of the first long side 516 of the first base sheet 510. The first guide sheet 560 is made of the same material as that of the first base sheet 510, and formed to extend outwards from one side portion of the first long side 516 direction (that is, the first short side 512 direction) of the first base sheet 510. At this time, the first guide sheet 560 is formed with a first guide hole 562 for coupling to the jig for manufacturing (not shown) used to couple the first ring-shaped antenna 500 in a ring shape.

The first guide sheet 560 is removed after coupling the first ring-shaped antenna 500 in a ring shape, and for this purpose, a plurality of holes for perforating the first guide sheet 560 are formed in a portion connected with the first base sheet 510 to form a first perforation 564. Here, as long as the first guide sheet 560 may be removed from the first base sheet 510, various modifications may be made in addition to the first perforation 564.

The second guide sheet 570 is formed on one side portion of the second long side 518 of the first base sheet 510. The second guide sheet 570 is made of the same material as that of the first base sheet 510 and formed to extend outwards from one side portion of the second long side 518 direction (that is, the first short side 512 direction) of the first base sheet 510. At this time, the second guide sheet 570 is formed with one or more second guide holes 572 for coupling to the jig for manufacturing (not shown) used to couple the first ring-shaped antenna 500 in a ring shape.

The second guide sheet 570 is removed after coupling the first ring-shaped antenna 500 in a ring shape, and for this purpose, a plurality of holes for perforating the second guide sheet 570 are formed in a portion connected with the first base sheet 510 to form a second perforation 574. Here, as long as the second guide sheet 570 may be removed from the first base sheet 510, various modifications may be made in addition to the second perforation 574.

The third guide sheet 580 is formed on the other side portion of the first long side 516 of the first base sheet 510. The third guide sheet 580 is made of the same material as that of the first base sheet 510, and formed to extend outwards from the other side portion of the first long side 516 direction (that is, the second short side 514 direction) of the first base sheet 510. At this time, the third guide sheet 580 is formed with one or more third guide holes 582 for coupling to the jig for manufacturing (not shown) used to couple the first ring-shaped antenna 500 in a ring shape.

The third guide sheet 580 is removed after coupling the first ring-shaped antenna 500 in a ring shape, and for this purpose, a plurality of holes for perforating the third guide sheet 580 are formed in a portion connected with the first base sheet 510 to form a third perforation 584. Here, as long as the third guide sheet 580 may be removed from the first base sheet 510, various modifications may be made in addition to the third perforation 584.

The fourth guide sheet 590 is formed on the other side portion of the second long side 518 of the first base sheet 510. The fourth guide sheet 590 is made of the same material as that of the first base sheet 510, and formed to extend outwards from the other side portion of the second long side 518 direction (that is, the second short side 514 direction) of the first base sheet 510. At this time, the fourth guide sheet 590 is formed with one or more fourth guide holes 592 for coupling to the jig for manufacturing (not shown) used to couple the first ring-shaped antenna 500 in a ring shape.

The fourth guide sheet 590 is removed after coupling the first ring-shaped antenna 500 in a ring shape, and for this purpose, a plurality of holes for perforating the fourth guide sheet 590 are formed in a portion connected with the first base sheet 510 to form a fourth perforation 594. Here, as long as the fourth guide sheet 590 may be removed from the first base sheet 510, various modifications may be made in addition to the fourth perforation 594.

The second ring-shaped antenna 600 is formed in a shape having a pair of long sides and a pair of short sides. The second ring-shaped antenna 600 is formed in a ring shape connecting the short side and having the second diameter (d2). At this time, since the second ring-shaped antenna 600 is located on the outer circumference of the first ring-shaped antenna 500, the second diameter (d2) is formed to be larger than the first diameter (d1).

Referring to FIGS. 18 and 19, the second ring-shaped antenna 600 includes a second base sheet 610, a second terminal sheet 620, a second radiation pattern 630, and a second connection pattern 640.

The second base sheet 610 is formed of a flexible printed circuit board (FPCB). That is, since the second ring-shaped antenna 600 is formed in a ring shape, the second base sheet 610 is formed of a flexible material that is easy to process into a ring shape. At this time, since the second base sheet 610 is formed in a ring shape, the second base sheet 610 may have a rectangular shape having a third short side 612, a fourth short side 614, a third long side 616, and a fourth long side 618.

The second terminal sheet 620 is formed to extend from one side of the second base sheet 610. The second terminal sheet 620 is formed to extend outwards from the third long side 616 or the fourth long side 618 of the second base sheet 610. Here, the second terminal sheet 620 overlaps the first terminal sheet 520 when the first ring-shaped antenna 500 and the second ring-shaped antenna 600 are coupled to each other.

The fourth terminal 622 and the fifth terminal 624 connected with the second radiation pattern 630 are located to be spaced apart from each other on the second terminal sheet 620.

The fourth terminal 622 is formed on one surface of the second terminal sheet 620 to be connected with one end of the second radiation pattern 630. At this time, the fourth terminal 622 may be composed of a pair of terminals formed on both surfaces of the second terminal sheet 620, respectively. Here, the fourth terminal 622 is connected to the third terminal 526 of the first ring-shaped antenna 500 through the via hole.

The fifth terminal 624 is formed to be spaced apart from the fourth terminal 622 on one surface of the second terminal sheet 620 to be connected with the other end of the second radiation pattern 630. At this time, the fifth terminal 624 may be composed of a pair of terminals formed on both surfaces of the second terminal sheet 620, respectively. Here, the fifth terminal 624 is connected to the first terminal 522 of the first ring-shaped antenna 500 through the via hole.

The second radiation pattern 630 is located on one surface (that is, upper surface) of the second base sheet 610. The second radiation pattern 630 is composed of a plurality of radiation lines 632 located on one surface of the second base sheet 610. The plurality of radiation lines 632 are located on one surface of the second base sheet 610 through processes such as deposition, printing, and plating. At this time, the plurality of radiation lines 632 are made of a metal material such as copper, aluminum, or silver, and located to be spaced apart from each other.

For example, when the second radiation pattern 630 is composed of a first radiation line to a $m^{th}$ radiation line, the first radiation line has one end connected with the fourth terminal 622, and has the other end connected with the second radiation line. The second radiation line to the $(m-1)^{th}$ radiation line have one ends connected to the previous radiation lines (that is, the first radiation line to the $(m-2)^{th}$ radiation line), and have the other ends connected with the next radiation lines (that is, the third radiation line to the $n^{th}$ radiation line). The $m^{th}$ radiation line has one end connected to the $(m-1)^{th}$ radiation line, and has the other end connected with the fifth terminal 624 through a connection pattern.

The second connection pattern 640 is formed on the other surface of the second base sheet 610. The second connection pattern 640 has one end connected with one of the plurality of radiation lines 632, and has the other end connected with the fifth terminal 624. At this time, the second connection pattern 640 has one end connected with the radiation line 632 through the via hole 642, and has the other end connected with the fifth terminal 624 formed on the other surface of the second terminal sheet 620. Accordingly, the second connection pattern 640 connects the other end of the second radiation pattern 630 to the fifth terminal 624.

Here, although it has been shown and described in FIG. 19 that the second connection pattern 640 is formed on the other surface (that is, the lower surface) of the second base sheet 610, it is not limited thereto, and the second base sheet 610 is formed to have a 2 Layer structure, and the second radiation pattern 630 and the second connection pattern 640 may also be formed on sheets different from each other.

Referring to FIG. 20, both ends of the second radiation pattern 630 are connected as the second ring-shaped antenna 600 of the above-described configuration is changed from a planar state into a ring shape. At this time, a protective sheet (not shown) is formed on both surfaces of the second base sheet 610 so that a portion of both ends of the second radiation pattern 630 is exposed to the outside, and both ends of the second radiation pattern 630 are electrically connected through the via hole 634.

Accordingly, the second radiation pattern 630 forms an antenna of a helical structure wound along the outer circumference of the second base sheet 610 changed into a ring shape.

Since the second ring-shaped antenna 600 should be manufactured in the sizes different from each other according to the size of the earphone module to be installed, the size of the second ring-shaped antenna 600 may be adjusted by adjusting the location where both ends of the second radiation pattern 630 are coupled.

Referring to FIGS. 21 and 22, the second ring-shaped antenna 600 may further include a second resistor pattern 650 formed on the other surface of the second base sheet 610.

The second ring-shaped antenna 600 forms the second resistor pattern 650 on the other surface of the second base sheet 610, and connects the second resistor pattern 650 with the second radiation pattern 630 formed on one surface of the second base sheet 610, thereby reducing the resistance of the second radiation pattern 630. At this time, the second resistor pattern 650 may be made of a metal material such as copper, aluminum, or silver.

The second resistor pattern 650 may be composed of a plurality of third resistor lines 652 located on the third short side 612 direction and a plurality of fourth resistor lines 656 located on the fourth short side 614 direction with respect to the second connection pattern 640 formed on the lower surface of the second base sheet 610.

The third resistor line 652 has one end portion connected with the radiation line 632 through the via hole 634, and has the other end portion connected with the radiation line 632 through the via hole 654. At this time, the other end portion of the third resistor line 652 is located to be spaced at a predetermined interval apart from the second connection pattern 640 formed on the other surface of the second base sheet 610, and connected with the radiation line 632 through the via hole. At this time, one of the plurality of third resistor lines 652 has the other end portion connected with the second connection pattern 640.

The fourth resistor line 654 has one end portion connected with the radiation line 632 through the via hole 658, and has the other end portion connected with the other end portion of the radiation line 632 through the via hole 634. At this time, one end portion of the fourth resistor line 654 is located to be spaced at a predetermined interval apart from the second connection pattern 640 formed on the other surface of the second base sheet 610, and connected to the radiation line 632 through the via hole. At this time, one of the plurality of fourth resistor lines 654 has one end portion extended to the second terminal sheet 620 to be connected with the fourth terminal 622.

Here, the third resistor line 652 and the fourth resistor line 654 may be formed variously in a length, the number thereof, an area, etc. according to the required Quality Factor, and only any one of the third resistor line 652 and the fourth resistor line 654 may also be formed.

Referring to FIG. 23, the second ring-shaped antenna 600 may further include a guide sheet for guiding the coupling location when changed from a planar state into a ring shape. For example, the guide sheet may further include a fifth guide sheet 660 to an eighth guide sheet 690.

The fifth guide sheet 660 is formed on one side portion of the third long side 616 of the second base sheet 610. The fifth guide sheet 660 is made of the same material as that of the second base sheet 610, and formed to extend outwards from one side portion of the third long side 616 direction (that is, the third short side 612 direction) of the second base sheet 610. At this time, the fifth guide sheet 660 is formed with a fifth guide hole 662 for coupling to the jig for manufacturing (not shown) used to couple the second ring-shaped antenna 600 in a ring shape.

The fifth guide sheet 660 is removed after coupling the second ring-shaped antenna 600 in a ring shape, and for this purpose, a plurality of holes for perforating the fifth guide sheet 660 are formed in a portion connected with the second base sheet 610 to form a fifth perforation 664. Here, as long as the fifth guide sheet 660 may be removed from the second base sheet 610, various modifications may be made in addition to the fifth perforation 664.

The sixth guide sheet 670 is formed on one side portion of the fourth long side 618 of the second base sheet 610. The sixth guide sheet 670 is made of the same material as that of the second base sheet 610, and formed to extend outwards from one side portion of the fourth long side 618 direction (that is, the third short side 612 direction) of the second base sheet 610. At this time, the sixth guide sheet 670 is formed with one or more sixth guide holes 672 for coupling to the jig for manufacturing (not shown) used to couple the second ring-shaped antenna 600 in a ring shape.

The sixth guide sheet 670 is removed after coupling the second ring-shaped antenna 600 in a ring shape, and for this purpose, a plurality of holes for perforating the sixth guide sheet 670 are formed in a portion connected with the second base sheet 610 to form the sixth perforation 674. Here, as long as the sixth guide sheet 670 may be removed from the second base sheet 610, various modifications may be made in addition to the sixth perforation 674.

The seventh guide sheet 680 is formed on the other side portion of the third long side 616 of the second base sheet 610. The seventh guide sheet 680 is made of the same material as that of the second base sheet 610, and formed to extend outwards from the other side portion of the third long side 616 direction (that is, the fourth short side 614 direction) of the second base sheet 610. At this time, the seventh guide sheet 680 is formed with one or more seventh guide holes 682 for coupling to the jig for manufacturing (not shown) used to couple the second ring-shaped antenna 600 in a ring shape.

The seventh guide sheet 680 is removed after coupling the second ring-shaped antenna 600 in a ring shape, and for this purpose, a plurality of holes for perforating the seventh guide sheet 680 are formed in a portion connected with the second base sheet 610 to form a seventh perforation 684. Here, as long as the seventh guide sheet 680 may be removed from the second base sheet 610, various modifications may be made in addition to the seventh perforation 684.

The eighth guide sheet 690 is formed on the other side portion of the fourth long side 618 of the second base sheet 610. The eighth guide sheet 690 is made of the same material as that of the second base sheet 610, and formed to extend outwards from the other side portion of the fourth long side 618 direction (that is, the fourth short side 614 direction) of the second base sheet 610. At this time, the eighth guide sheet 690 is formed with one or more eighth guide holes 692 for coupling to the jig for manufacturing (not shown) used to couple the second ring-shaped antenna 600 in a ring shape.

The eighth guide sheet 690 is removed after coupling the second ring-shaped antenna 600 in a ring shape, and for this purpose, a plurality of holes for perforating the eighth guide sheet 690 are formed in a portion connected with the second base sheet 610 to form an eighth perforation 694. Here, as long as the eighth guide sheet 690 may be removed from the second base sheet 610, various modifications may be made in addition to the eighth perforation 694.

The ring-shaped antenna 400 is formed by locating the second ring-shaped antenna 600 on the outer circumference of the first ring-shaped antenna 500. At this time, referring to FIG. 24, the ring-shaped antenna 400 forms a via hole in a state where the fifth terminal 624 of the second ring-shaped antenna 600 has been located at the first terminal 522 of the first ring-shaped antenna 500 to electrically connect the first terminal 522 and the fifth terminal 624. The ring-shaped antenna 400 forms a via hole in a state where the fourth terminal 622 of the second ring-shaped antenna 600 has been located on the third terminal 526 of the first ring-shaped antenna 500 to electrically connect the third terminal 526 and the fourth terminal 622.

Accordingly, the first radiation pattern 530 of the first ring-shaped antenna 500 and the second radiation pattern 630 of the second ring-shaped antenna 600 form an antenna of one helical structure to operate as an NFMI antenna.

Meanwhile, since a coverlay sheet (not shown) is located on both surfaces of the first ring-shaped antenna 500 and the second ring-shaped antenna 600, the insulation state between the two antennas is maintained.

At this time, both ends (that is, both short sides) of the first ring-shaped antenna 500 and the second ring-shaped antenna 600 may not maintain the insulation because a portion of the radiation patterns (that is, the first radiation pattern 530 and the second radiation pattern 630) is exposed to the outside in a process of being changed into the ring shape.

Accordingly, the ring-shaped antenna 400 may also have an insulating material or an adhesive agent located between the first ring-shaped antenna 500 and the second ring-shaped antenna 600.

As described, it is possible for the ring-shaped antenna 400 to locate the second ring-shaped antenna 600 on the outer circumference of the first ring-shaped antenna 500, thereby maximizing the antenna performance by maximizing the inductance in the same shape and the same size.

Referring to FIG. 25, the ring-shaped antenna 400 is located on the outer circumference of the coin-type battery 560 mounted to the earphone module. That is, the ring-shaped antenna 400 is located so that the inner circumference of the first ring-shaped antenna 500 surrounds the side surface outer circumference of the coin-type battery 560 of the earphone module, and located so that the second ring-shaped antenna 600 surrounds the inner circumference of the first ring-shaped antenna 500.

At this time, the ring-shaped antenna 400 may further include a magnetic sheet (not shown) located between the first ring-shaped antenna 500 and the coin-type battery 560. Here, the magnetic sheet may be composed of a ferrite sheet, a flexible polymer sheet, etc.

The ring-shaped antenna 400 may also be located between the outer circumferences of the coin-type battery 560 and the housing of the earphone module. That is, the ring-shaped antenna 400 may be located so that the inner circumference thereof surrounds the side surface outer circumference of the coin-type battery 560 and located so that the outer circumference thereof is adjacent to the inner wall surface of the housing.

The ring-shaped antenna 400 is connected with the circuit board through the first terminal 522 and the third terminal 526 of the terminal sheet (that is, the first terminal sheet 520 and the second terminal sheet 620). That is, the terminal sheet is bent outwards from the ring-shaped antenna 400, and the first terminal 522 and the third terminal 526 formed on the terminal sheet are connected to the circuit board located outside the ring-shaped antenna 400. At this time, the first terminal 522 and the third terminal 526 may be electrically connected to the circuit board through soldering, or electrically connected to the circuit board through a conductive adhesive agent.

Referring to FIG. 26, the ring-shaped antenna 400 may also be located on the outer circumferences of the coin-type battery 560 and the circuit board 580 of the earphone module. That is, the ring-shaped antenna 400 is located so that the inner circumference thereof surrounds the outer circumference of the coin-type battery 560 and the outer circumference of the circuit board 580 located on one surface of the coin-type battery 560.

The ring-shaped antenna 400 is connected with the circuit board 580 through the first terminal 522 and the third terminal 526 of the terminal sheet (that is, the first terminal sheet 520 and the second terminal sheet 620). That is, the terminal sheet is bent inwards from the ring-shaped antenna 400, and the first terminal 522 and the third terminal 526 formed on the terminal sheet are connected to the circuit board 580 located inside the ring-shaped antenna 400. At this time, the first terminal 522 and the third terminal 526 may be electrically connected to the circuit board 580 through soldering, or electrically connected to the circuit board 580 through a conductive adhesive agent.

As described above, although the preferred embodiment according to the present disclosure has been described, it is understood that modifications may be made in various forms, and those skilled in the art may carry out various changes and modifications without departing from the scope of claims of the present disclosure.

The invention claimed is:

1. A ring-shaped antenna, comprising:

a flexible base sheet;

a terminal sheet formed to extend from one side of the base sheet;

a first terminal formed on one surface of the terminal sheet;

a second terminal formed to be spaced apart from the first terminal on one surface of the terminal sheet;

a radiation pattern formed on one surface of the base sheet, one end of the radiation pattern connected with the first terminal, and the other end of the radiation pattern connected with the second terminal;

a resistor pattern formed on the other surface of the base sheet to be connected with the radiation pattern, wherein the radiation pattern comprises a plurality of radiation lines formed to be spaced apart from each other on one surface of the base sheet, wherein the resistor pattern comprises:

a plurality of first resistor lines located to be spaced apart from each other in a first short side direction of the base sheet and a plurality of second resistor lines located to be spaced apart from each other in a second short side direction of the base sheet, and spaced apart from the first resistor line, and wherein each of the plurality of first resistor lines and each of the plurality of second resistor lines are connected with one of a plurality of radiation lines formed on one surface of the base sheet through a via hole.

2. The ring-shaped antenna of claim 1, wherein the terminal sheet is formed to extend outwards from one selected from a first long side and a second long side of the base sheet.

3. The ring-shaped antenna of claim 1, wherein a first radiation line among the plurality of radiation lines has one end connected to the first terminal, and a $n^{th}$ radiation line among the plurality of radiation lines has the other end connected to the second terminal.

4. The ring-shaped antenna of claim 3, wherein a second radiation line to a $(n-1)^{th}$ radiation line have one ends connected to the other ends of the first radiation line to the $(n-2)^{th}$ radiation line, respectively, and have the other ends connected to one ends of a third radiation line to the $n^{th}$ radiation line, respectively, when the base sheet is changed into a ring shape.

5. The ring-shaped antenna of claim 1, further comprising a connection pattern formed on the other surface of the base sheet, one end of the connection pattern connected with the other end of the radiation pattern, and the other end of the connection pattern connected with the second terminal.

6. The ring-shaped antenna of claim 1, wherein one of the plurality of first resistor lines is connected with the second terminal, and another one of the plurality of second resistor lines is connected with the first terminal.

7. The ring-shaped antenna of claim 1, further comprising:

an electrode sheet located on the other surface of the base sheet; and an electrode pattern formed on one surface of the electrode sheet.

8. The ring-shaped antenna of claim 7, wherein the long side of the electrode sheet is formed to be shorter than the long side of the base sheet.

9. The ring-shaped antenna of claim 7, wherein the electrode sheet comprises a main body part located on the other surface of the base sheet and a protrusion formed to extend from one side facing the terminal sheet, and wherein the electrode pattern is formed over the main body part and the protrusion, and one end of the electrode pattern is connected with a third terminal formed on the terminal sheet.

10. A ring-shaped antenna, comprising:

as the ring-shaped antenna mounted to an earphone module, a first ring-shaped antenna having a first radiation pattern formed on one surface thereof, and located along the outer circumference of a coin-type battery mounted to the earphone module; and a second ring-shaped antenna having a second radiation pattern formed on one surface thereof, and located along the outer circumference of the first ring-shaped antenna wherein the first ring-shaped antenna comprises:

a first terminal connected to one end of the first radiation pattern;

a second terminal connected to the other end of the first radiation pattern; and a third terminal spaced apart from the first terminal and the second terminal, and wherein the second ring-shaped antenna comprises:

a fourth terminal connected to one end of the second radiation pattern, and connected to the third terminal of the first ring-shaped antenna; and a fifth terminal connected to the other end of the second radiation pattern, and connected with the second terminal of the first ring-shaped antenna.

11. The ring-shaped antenna of claim 10, wherein the diameter of the first ring-shaped antenna is formed to be shorter than the diameter of the second ring-shaped antenna.

12. The ring-shaped antenna of claim 10, wherein the first terminal and the second terminal are connected to a circuit board of the earphone module.

13. The ring-shaped antenna of claim 10, wherein one selected from an insulating material, an adhesive agent, and a coverlay is interposed between the first ring-shaped antenna and the second ring-shaped antenna.

* * * * *